US010285521B2

(12) United States Patent
Oakes et al.

(10) Patent No.: US 10,285,521 B2
(45) Date of Patent: May 14, 2019

(54) DISPOSABLE CUP LID

(71) Applicant: GPCP IP Holdings LLC, Atlanta, GA (US)

(72) Inventors: Shawn A. Oakes, Ripon, WI (US); Cheryl Ann Mocadlo, Verona, WI (US); Danielle Marie Sherriff, Oshkosh, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 223 days.

(21) Appl. No.: 15/254,216

(22) Filed: Sep. 1, 2016

(65) Prior Publication Data

US 2017/0055742 A1 Mar. 2, 2017

Related U.S. Application Data

(60) Provisional application No. 62/213,484, filed on Sep. 2, 2015.

(51) Int. Cl.
*A47G 19/22* (2006.01)
*B65D 43/02* (2006.01)

(52) U.S. Cl.
CPC ..... *A47G 19/2272* (2013.01); *B65D 43/0212* (2013.01); *B65D 2543/00027* (2013.01);
(Continued)

(58) Field of Classification Search
CPC ..... A47G 19/2272; B65D 2543/00027; B65D 2543/00222; B65D 2543/0012; B65D 2543/00046
See application file for complete search history.

(56) References Cited

U.S. PATENT DOCUMENTS 4,828,141 A 5/1989 Coy
4,836,404 A 6/1989 Coy
(Continued)

FOREIGN PATENT DOCUMENTS

WO 2014008763 A1 1/2014
WO 2014014844 A1 1/2014

OTHER PUBLICATIONS

International Search Report of International App. No. PCT/US2018/049892, mailed by the International Searching Authority dated Dec. 20, 2018.

(Continued)

*Primary Examiner* — Andrew T Kirsch
*Assistant Examiner* — Don M Anderson

(57) ABSTRACT

A disposable cup lid for use with a beverage container can include a base, an annular rim, a crown, and a dispensing section having a drinking aperture. The annular rim can be disposed about the base and can be configured to engage the beverage container. The crown can extend upward from the base and can include an upper surface, one or more inner sidewalls, and one or more outer sidewalls. The dispensing section can be located within a portion of the crown and can include an upper surface, one or more inner sidewalls, and one or more outer sidewalls. The dispensing section can include at least one generally straight portion of the inner sidewall that is directly opposed to at least one generally straight portion of the outer sidewall. The drinking aperture can be formed through the upper surface of the dispensing section for allowing the passage of fluid therethrough.

22 Claims, 17 Drawing Sheets

(52) U.S. Cl.
CPC ..... *B65D 2543/00046* (2013.01); *B65D 2543/00092* (2013.01); *B65D 2543/00222* (2013.01); *B65D 2543/00296* (2013.01); *B65D 2543/00555* (2013.01); *B65D 2543/00731* (2013.01); *B65D 2543/00796* (2013.01)

(56) References Cited

U.S. PATENT DOCUMENTS

| | | | | |
|---|---|---|---|---|
| 4,946,062 | A | 8/1990 | Coy | |
| 5,813,559 | A | 9/1998 | Cho | |
| 7,111,749 | B1 | 9/2006 | Akers | |
| 7,191,911 | B2 | 3/2007 | O'Neill | |
| 7,731,047 | B2 | 6/2010 | Ishimitsu | |
| D658,059 | S | 4/2012 | Bailey | |
| 8,167,162 | B2 | 5/2012 | Levey | |
| 8,381,935 | B1 | 2/2013 | Buck | |
| 8,490,818 | B2 | 7/2013 | Akers | |
| 8,596,491 | B2 | 12/2013 | Buck | |
| 8,631,957 | B2 | 1/2014 | Dart et al. | |
| 8,708,181 | B2 | 4/2014 | Buck | |
| 8,714,393 | B2 | 5/2014 | Buck | |
| 8,733,583 | B2 | 5/2014 | Bailey | |
| 8,870,010 | B2 | 10/2014 | Buck | |
| 8,960,476 | B2 | 2/2015 | Nurse, Sr. | |
| 9,096,358 | B2 | 8/2015 | Bailey | |
| 9,604,764 | B2 | 3/2017 | Bailey | |
| 2002/0027139 | A1 | 3/2002 | O'Neill | |
| 2005/0092749 | A1 | 5/2005 | Durdon | |
| 2006/0289548 | A1 | 12/2006 | Schatz | |
| 2007/0075079 | A1 | 4/2007 | Stokes | |
| 2007/0075081 | A1 | 4/2007 | Stokes | |
| 2007/0278239 | A1 | 12/2007 | Vogt | |
| 2008/0011762 | A1 | 1/2008 | Boone | |
| 2008/0029512 | A1 | 2/2008 | Smith et al. | |
| 2009/0206089 | A1 | 8/2009 | Mueller | |
| 2011/0068113 | A1 | 3/2011 | Kim | |
| 2011/0220649 | A1 | 9/2011 | Akers | |
| 2013/0068773 | A1 | 3/2013 | Buck | |
| 2013/0068774 | A1 | 3/2013 | Buck | |
| 2013/0140314 | A1 | 6/2013 | Pinotti | |
| 2014/0231436 | A1 | 8/2014 | Buck | |
| 2016/0255972 | A1 | 9/2016 | Lurie | |
| 2016/0325890 | A1* | 11/2016 | Hong | A47G 19/2272 |
| 2016/0345762 | A1* | 12/2016 | Brannock | A47G 19/2272 |

OTHER PUBLICATIONS

Written Opinion of International App. No. PCT/US2016/049892, mailed by the International Searching Authority dated Dec. 20, 2016.

* cited by examiner

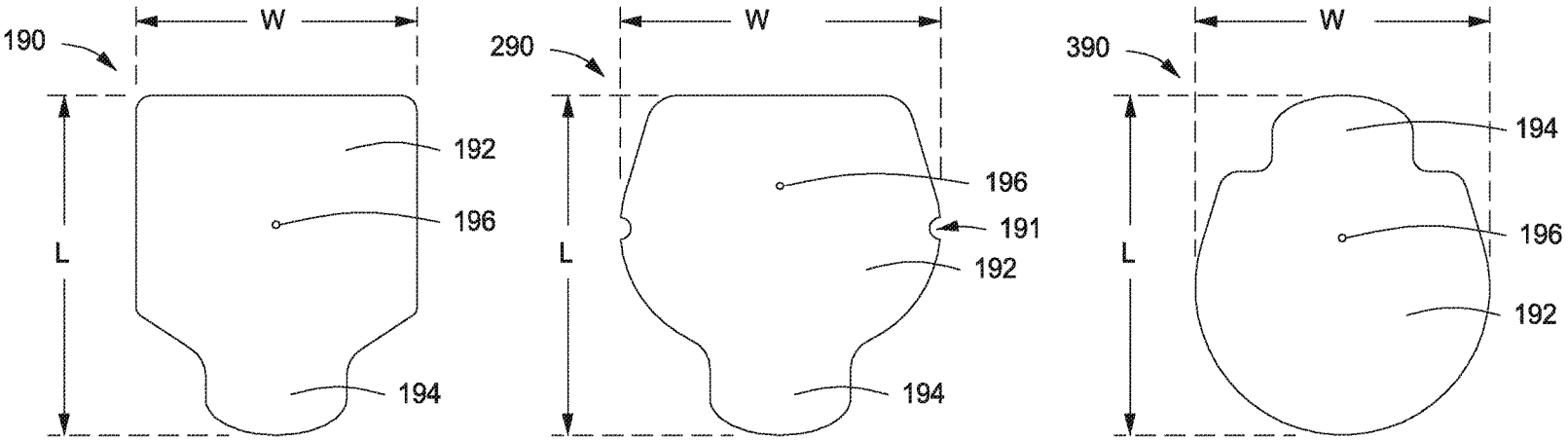
FIG. 13
FIG. 14
FIG. 15
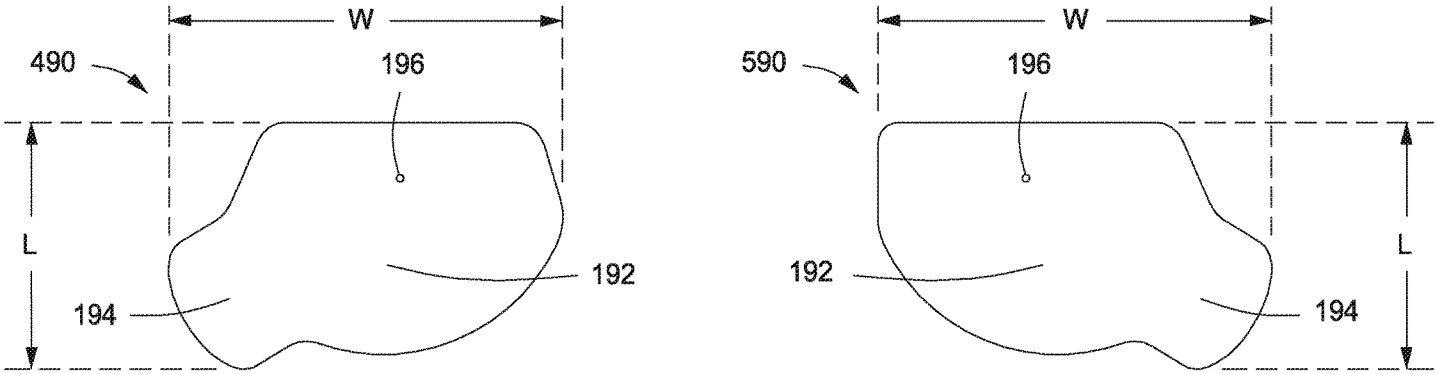
FIG. 16
FIG. 17

DISPOSABLE CUP LID

BACKGROUND

Field

Embodiments described generally relate to cup lids. More particularly, such embodiments relate to disposable cup lids having a dispensing section with sidewalls and a drinking aperture.

Description of the Related Art

Disposable cup lids are used by merchants selling hot beverages, such as coffee, tea, and cocoa. Disposable cup lids typically have a drinking area that is raised above an annular rim that snaps onto a cup. The drinking area will have an opening or sip hole through which a user can drink from the cup. Since the sip hole is vertically offset from the rim of the cup, there is a reduced likelihood that the liquid within the cup will splash from the sip hole upon a moderate bump or jolt of the cup.

Many disposable cup lids also have a flap or a sliding panel that is configured to cover the sip hole. The flap or the sliding panel, when closed, can help reduce or eliminate spillage. The flap or the sliding panel, when closed, can also help reduce or eliminate contaminants from entering and contacting the beverage via the sip hole. The area surrounding the sip hole, i.e., the area which is likely to contact with a user's mouth, however, can be exposed to contaminants whether airborne or by contact.

This exposed drinking area can be contaminated at the point of sale, or prior to use while in storage, or when stacked on beverage service counters, or in transit before the user is able to drink from the cup, for examples. More often, the exposed drinking area of such traditional cup lids, whether employing a sliding panel or not, is contaminated when handled by the seller or server of the beverage or at self-serve counters where customers prepare their own drinks with lids that have been touched by or otherwise exposed to previous customers.

There is a need, therefore, for an improved disposable cup lid having a drinking area that is more effectively protected over conventional cup lids against contamination, therefore more hygienic, prior to use.

SUMMARY

In some examples, a disposable cup lid for use with a beverage container can include a base, an annular rim disposed about the base and configured to engage the beverage container, and a crown extending upward from at least a portion of the base. The crown can include an upper surface, an inner sidewall, and an outer sidewall. A dispensing section can be located within a portion of the crown and can include an upper surface, an inner sidewall, and an outer sidewall. A generally straight portion of the inner sidewall of the dispensing section can oppose a generally straight portion of the outer sidewall of the dispensing section. A drinking aperture can be formed through the upper surface of the dispensing section to allow fluid to pass therethrough.

In other examples, the disposable cup lid can include an annular rim configured to engage the beverage container and a crown extending upward from at least a portion of the annular rim. A first section of the outer sidewall of the crown can be generally circular having an arc with an angle of about 270 degrees to about 330 degrees centered with the annular rim. A second section of the outer sidewall of the crown can include the generally straight portion of the outer sidewall of the dispensing section. The inner sidewall of the crown can include two generally circular sections having a common center separated by two generally straight sections. Each of the generally circular sections of the inner sidewall of the crown can have an arc with an angle of about 90 degrees to about 130 degrees centered with the annular rim.

In other examples, the disposable cup lid can include an annular rim configured to engage the beverage container and a crown extending upward from at least a portion of the annular rim. A first section of the outer sidewall of the crown can be generally circular and centered with the annular rim. A second section of the outer sidewall of the crown can include the generally straight portion of the outer sidewall of the dispensing section. The inner sidewall of the crown can include two generally circular sections centered with the annular rim separated by two generally straight sections. Each of the two generally circular sections of the inner sidewall of the crown can have an arc with an angle of greater than 90 degrees. The two generally straight sections of the inner sidewall of the crown can be generally parallel in at least one dimension. One of the two generally straight sections of the inner sidewall of the crown can include the generally straight portion of the inner sidewall of the dispensing section.

BRIEF DESCRIPTION OF THE DRAWINGS

So that the manner in which the above recited features can be understood in detail, a more particular description, briefly summarized above, may be had by reference to embodiments, some of which are illustrated in the appended drawings. It is to be noted, however, that the appended drawings illustrate only typical embodiments and are therefore not to be considered limiting of its scope, for the invention may admit to other equally effective embodiments.

FIG. 13 depicts an illustrative removable label having a pull tab centered on the bottom of a barrier section, according to one or more embodiments described.

FIG. 14 depicts another illustrative removable label having a pull tab centered on the bottom of a barrier section, according to one or more embodiments described.

FIG. 15 depicts an illustrative removable label having a pull tab centered on the top of a barrier section, according to one or more embodiments described.

FIG. 16 depicts an illustrative removable label having a pull tab on the bottom left of a barrier section, according to one or more embodiments described.

FIG. 17 depicts an illustrative removable label having a pull tab on the bottom right of a barrier section, according to one or more embodiments described.

DETAILED DESCRIPTION

Figure 1:
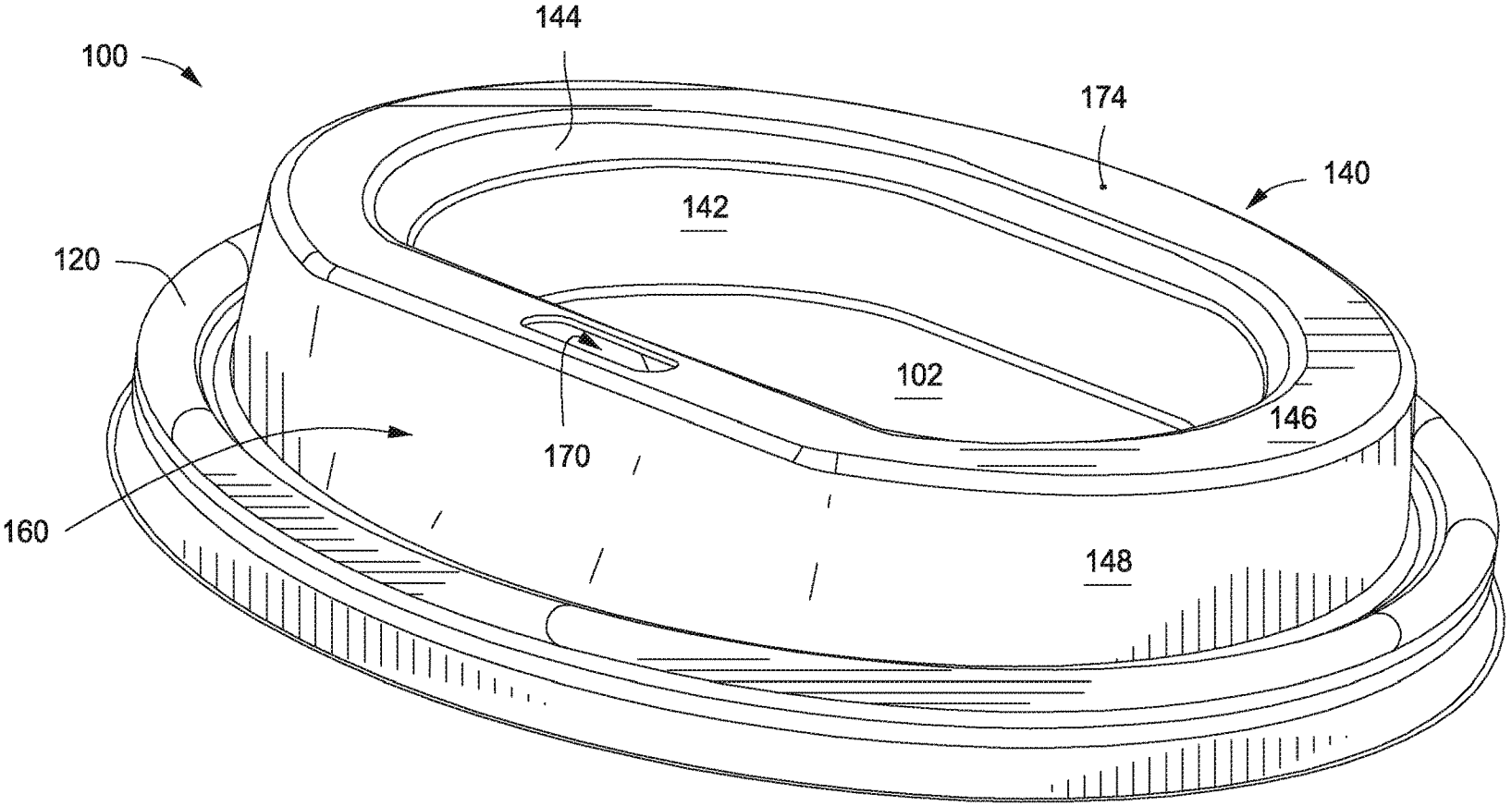
FIG. 1 depicts a perspective view of an illustrative cup lid, according to one or more embodiments described.

FIG. 1 depicts a perspective view of an illustrative cup lid 100, according to one or more embodiments described herein. The cup lid 100 can include a base 102 surrounded by an outer periphery or rim 120. A crown 140 having a dispensing section 160 and a drinking aperture 170 can be elevated or otherwise extend upwardly above the base 102. The drinking aperture 170, also known as a sip hole, can allow fluid to pass through the cup lid 100 via the dispensing section 160. The rim 120 can be annular and can have a recessed groove formed on a lower surface thereof that is adapted to snap onto or otherwise fit a ridge of a beverage container, such as a disposable cup. For example, the cup can be any container, whether disposable or not, that is capable of use with the cup lid 100.

The crown 140 can have an inner sidewall 142, an upper surface 146, and an outer sidewall 148. The crown 140 can be continuous around the base 102, as depicted in FIG. 1, or the crown 140 can be formed about only a portion of the base 102. The upper surface 146 can be located between the sidewalls 142, 148 of the crown 140 and can connect the sidewalls 142, 148. The sidewalls 142, 148 can be perpendicular or at least substantially perpendicular to the base 102 and/or the rim 120. Alternatively, the sidewalls 142, 148 can be tilted or angled from the base 102 toward the upper surface 146 of the crown 140. At least a portion of the inner sidewall 142 of the crown 140 can also have a beveled inner section or surface 144 formed adjacent an upper portion thereof. The beveled inner surface 144 can facilitate the stacking of two or more lids 100, as explained in more detail below.

The crown 140 can further have one or more vent holes 174 formed through the upper surface 146. For example, the vent hole 174 can be formed through the upper surface 146 of the crown 140 as depicted in FIG. 1. The one or more vent holes 174 also can be formed through any one or more sidewalls 142, 148, the base 102, or the dispensing section 160. During use, the vent hole 174 can provide air passage into the attached cup to better achieve pressure equilibrium within the cup, reducing the likelihood of or preventing a vacuum as the user drinks the liquid.

Figure 2:
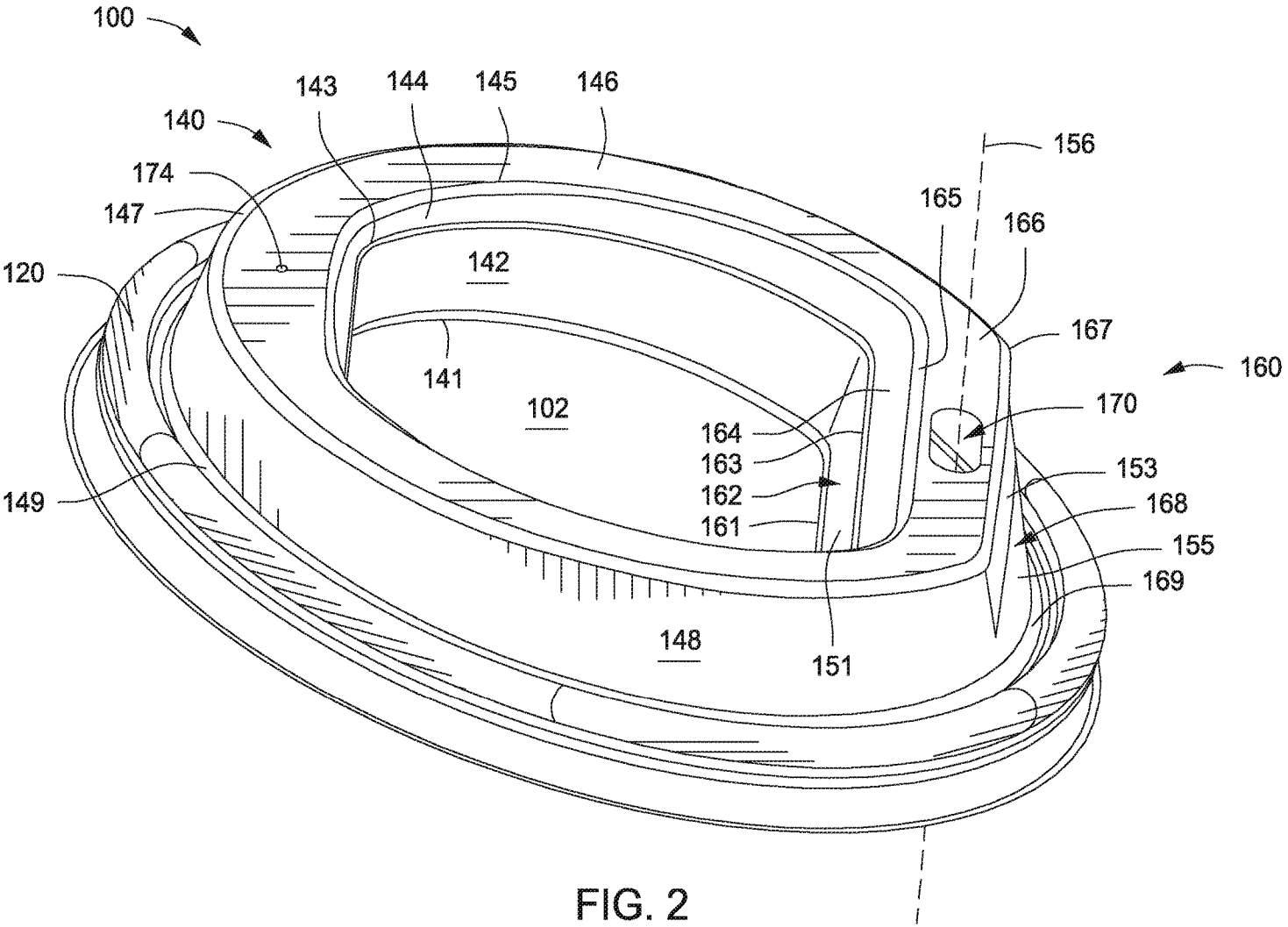
FIG. 2 depicts another perspective view of the cup lid shown in FIG. 1.

Considering the crown 140 in more detail, FIG. 2 depicts a side view of the cup lid 100 shown in FIG. 1. The crown 140 can have one or more transition sections 141, 143, 145, 147, 149 located between the upper surface 146 and the sidewalls 142, 148. The transition sections 141, 143, 145, 147, 149 can be planar, rounded or curved. The transition sections 141, 143, 145, 147, 149 can provide uniform and smooth surfaces to improve aesthetics and mouth feel of the cup lid 100, to increase stacking density of the cup lid 100, as well as to ease or facilitate manufacturing of the cup lid 100.

The dispensing section 160 can also have any number of angled or rounded transition sections (such as 161, 163, 165, 167, 169) located between the upper surface 166 and the sidewalls 162, 168. The transition sections 161, 163, 165, 167, 169 can be planar, rounded or curved. Like the transition sections of the crown 140, these transition sections 161, 163, 165, 167, 169 can provide uniform and smooth surfaces to improve aesthetics, increase stacking density, and facilitate manufacturing of the cup lid 100. The transition sections 165, 167 located between the upper surface 166 and the sidewalls 162, 168 also can provide comfortable, smooth surfaces for the placement of a user's mouth about the dispensing section 160 when drinking from the drinking aperture 170.

In some examples, the transition sections 165, 167 can be positioned at a draft angle of about 1 degree, about 2 degrees, or about 3 degrees to about 4 degree, about 5 degrees, about 6 degrees, about 8 degrees, or about 10 degrees. For example, the transition sections 165, 167 independently can be positioned at a draft angle of about 1 degree to about 10 degrees, about 2 degrees to about 6 degrees, about 2 degrees to about 5 degrees, about 2 degrees to about 4 degrees, about 2 degrees to about 3 degrees, about 3 degrees to about 6 degrees, about 3 degrees to about 5 degrees, about 3 degrees to about 4 degrees, or about 4 degrees to about 5 degrees.

Figure 3:
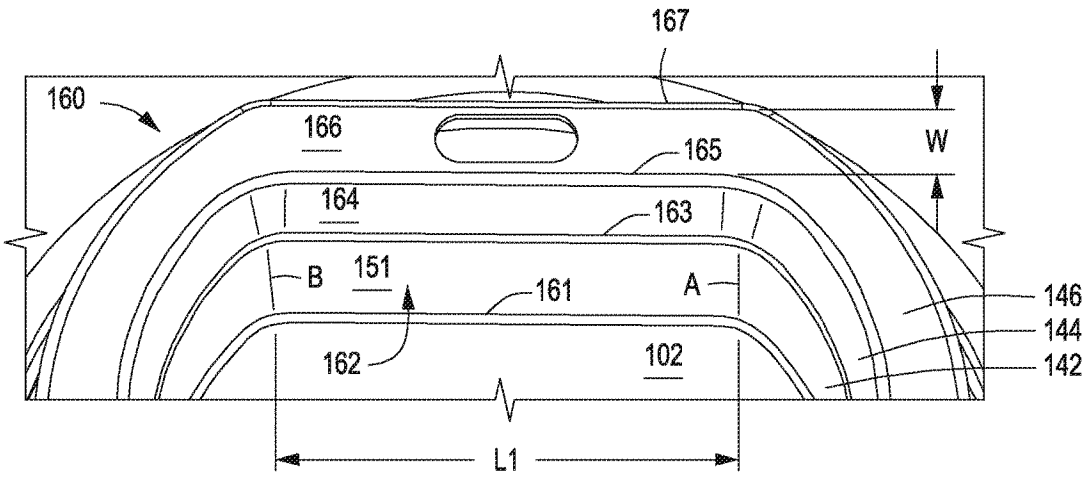
FIG. 3 depicts a close-up view of a portion of the cup lid shown in FIG. 1.
Figure 4:
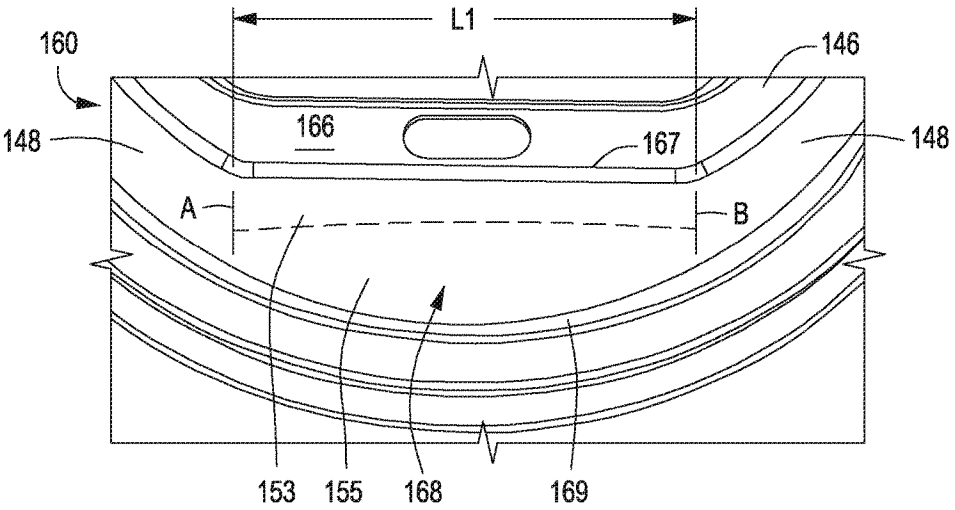
FIG. 4 depicts a close-up view of another portion of the cup lid shown in FIG. 1.

To further illustrate the dispensing section 160, FIGS. 3 and 4 depict an enlarged perspective view of the inner and outer sidewalls 162, 168 of the dispensing section 160. As depicted, the dispensing section 160 is disposed within a portion of the crown 140. The dispensing section 160 can be located anywhere on or within the crown 140. The dispensing section 160 is preferably located at or adjacent the highest point of the crown 140.

The dispensing section 160 can have an inner sidewall 162 and an outer sidewall 168. An upper surface 166 is located between the sidewalls 162, 168 and connects the sidewalls 162, 168 to one another. The upper surface 166 can be generally straight and flat. The upper surface 166 also can be rounded, bent, curved, ridged, or have any other contoured profile, or combinations thereof.

Each sidewall 162, 168 of the dispensing section 160 can have at least a portion thereof that is generally straight. By "generally straight" it is meant that the surfaces or sidewalls are substantially or completely flat or substantially or completely planar minus any minor manufacturing imperfections or damage due to packaging or transportation. For example, surfaces 151, 153, and 164 can be generally straight. The generally straight portions 151, 153, 164 can directly oppose one another. For example, the generally straight portions 151, 164 of the inner sidewall 162 can directly oppose the generally straight portion 153 of the outer sidewall 168, and align on either side of the drinking aperture 170.

The generally straight portion 151, 153, 164 of each sidewall 162, 168 can be parallel to the vertical. The generally straight portions 151, 153, 164 also can be offset or angled relative to the vertical. For example, the generally straight portions 151, 153, 164 can be tilted forward or backward relative to a centerline 156 of the dispensing section 160. The generally straight portion 151, 153, 164 also can be parallel to one another.

As shown in FIGS. 2-4, the inner and outer sidewalls 162, 168 can have one or more portions thereof that are non-straight, i.e., curved, rounded, bulged, or bent. For example, the outer sidewall 168 can include a non-straight portion 155 near or adjacent the bottom of the dispensing section 160. The non-straight portion 155 can help transition from a rounded profile of the rim 120 to a flat or planar profile of the generally straight portion 153 of the outer sidewall 168.

The upper surface 166 of the dispensing section 160 has a width (W) as shown in FIG. 3. The width W of the upper surface 166 is the distance between upper most ends of the inner sidewall 162 and the outer sidewall 168. The width (W) of the upper surface 166 can be about 2 mm, about 3 mm, about 4 mm, or about 5 mm to about 6 mm, about 8 mm, about 10 mm, about 12 mm, about 15 mm, or greater. For example, the width (W) of the upper surface 166 can be about 2 mm to about 10 mm, about 2 mm to about 8 mm, about 2 mm to about 6 mm, about 2 mm to about 5 mm, about 2 mm to about 4 mm, about 3 mm to about 10 mm, about 3 mm to about 8 mm, about 3 mm to about 6 mm, about 3 mm to about 5 mm, about 3 mm to about 4 mm, about 4 mm to about 10 mm, about 4 mm to about 8 mm, about 4 mm to about 6 mm, about 4 mm to about 5 mm, about 5 mm to about 10 mm, about 5 mm to about 8 mm, about 5 mm to about 7 mm, or about 5 mm to about 6 mm.

Each generally straight portion 151, 153, 164 can have a length (L1) that is measured from end to end, as depicted by points A and B. At points A and B, the inner sidewall 162 of the dispensing section 160 intersects with the inner sidewall 142 of the crown 140. Also at points A and B, the outer sidewall 168 of the dispensing section 160 intersects with the outer sidewall 148 of the crown 140. Said another way, points A and B are the endpoints of the dispensing section 160, and identify the drinking area of the dispensing section 160.

The length (L1) of each generally straight portion 151, 153, 164 can be the same or can be different. The length (L1) of each generally straight portion 151, 153, 164, for example, can be about 15 mm, about 20 mm, about 25 mm, or about 30 mm to about 33 mm, about 35 mm, about 38 mm, about 40 mm, about 42 mm, about 45 mm, about 50 mm, about 60 mm, or greater. The length (L1) also can be about 15 mm to about 60 mm, about 20 mm to about 50 mm, about 30 mm to about 50 mm, about 40 mm to about 50 mm, about 20 mm to about 40 mm, about 30 mm to about 40 mm, about 35 mm to about 40 mm, about 20 mm to about 35 mm, about 20 mm to about 50 mm, about 25 mm to about 35 mm, about 25 mm to about 45 mm, about 30 mm to about 35 mm, or about 35 mm to about 45 mm. In some examples, length (L1) can be about 20 mm to about 60 mm and the width (W) can be about 2 mm to about 10 mm. In other examples, the length (L1) can be about 25 mm to about 45 mm and the width (W) can be about 3 mm to about 8 mm. The length (L1) also can be about 30 mm to about 40 mm and the width (W) can be about 4 mm to about 6 mm.

The drinking aperture 170 can be positioned in any suitable location within the dispensing section 160. The drinking aperture 170 can be formed, for example, through the upper surface 166, as shown. The drinking aperture 170 also can be formed in the generally straight outer sidewall 168. The drinking aperture 170 can be any suitably shaped opening or hole. For example, the drinking aperture 170 can be circular, elliptical, oval, square, triangular or any other polygonal shape. The size or area of the drinking aperture 170 can be about 10 $mm^2$, about 20 $mm^2$, about 30 $mm^2$, about 40 $mm^2$, or about 45 $mm^2$ to about 50 $mm^2$, about 55 $mm^2$, about 60 $mm^2$, about 80 $mm^2$, about 100 $mm^2$, about 125 $mm^2$, about 150 $mm^2$, or greater. The size or area of the drinking aperture 170 also can be about 10 $mm^2$ to about 150 $mm^2$, about 20 $mm^2$ to about 100 $mm^2$, about 20 $mm^2$ to about 80 $mm^2$, about 20 $mm^2$ to about 60 $mm^2$, about 20 $mm^2$ to about 50 $mm^2$, about 30 $mm^2$ to about 80 $mm^2$, about 30 $mm^2$ to about 60 $mm^2$, about 30 $mm^2$ to about 50 $mm^2$, about 40 $mm^2$ to about 80 $mm^2$, about 40 $mm^2$ to about 60 $mm^2$, about 40 $mm^2$ to about 50 $mm^2$, or about 45 $mm^2$ to about 55 $mm^2$.

Figure 5:
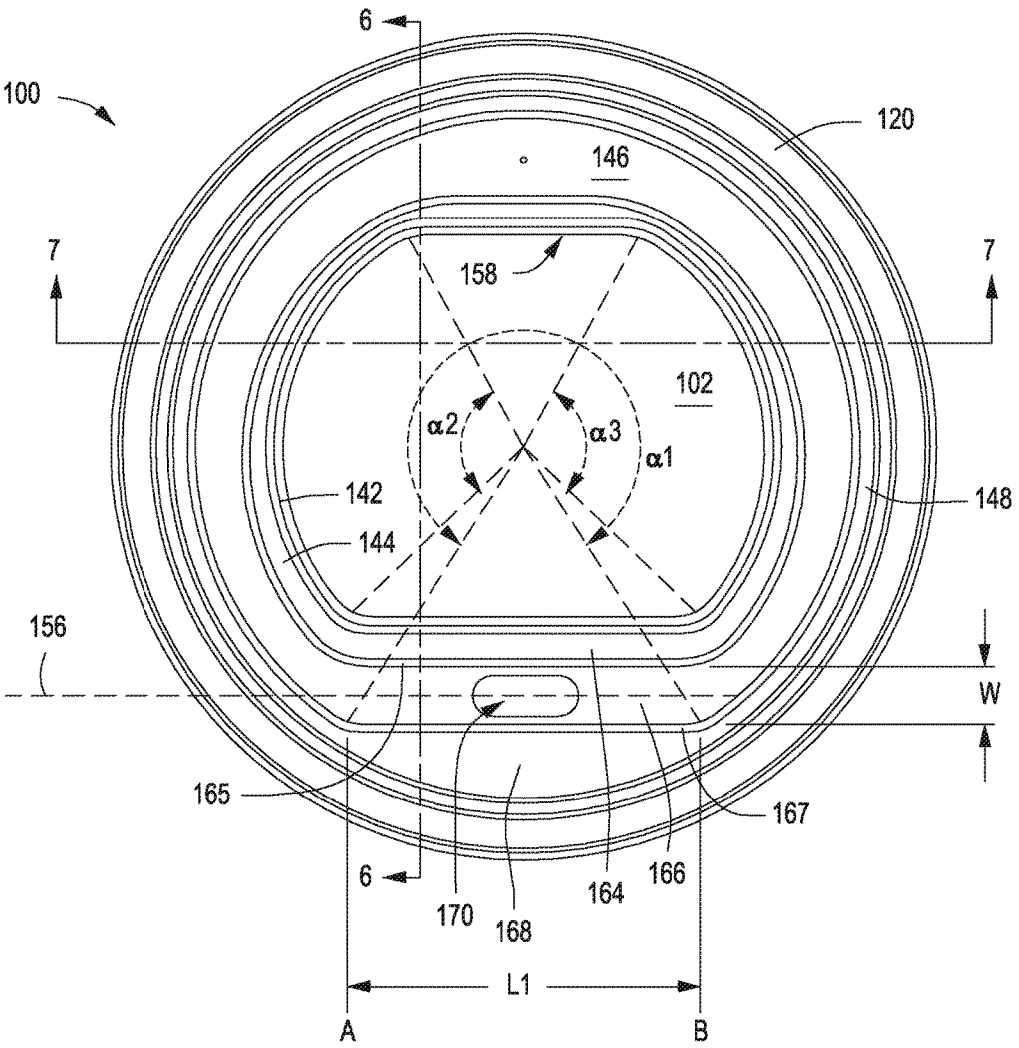
FIG. 5 depicts a top plan view of the cup lid shown in FIG. 1.

Considering the crown 140 in more detail, FIG. 5 depicts a top plan view of the cup lid shown in FIG. 1. The outer sidewall 148 of the crown 140 can be generally circular beyond the outer sidewall 168 of the dispensing section 160 (e.g., outside of points A and B). Alternatively, in other embodiments, the outer sidewall 148 of the crown 140 can have one or more straight surfaces disposed beyond the outer sidewall 168 of the dispensing section 160. By "generally circular" it is meant that the surface is mostly curved from end to end having a constant radius, less any manufacturing imperfections or damage due to packaging or transportation. The outer sidewall 148 can have a radius of curvature defined by angle ($\alpha_1$) that originates from the center point of the cup lid 100 (e.g., the center of the rim 120), and is located along the major arc between endpoints A, B. The angle $\alpha_1$ can be greater than 200 degrees, greater than 230 degrees, greater than 250 degrees, greater than 270 degrees, greater than 290 degrees, or greater than 295 degrees, but less than 305 degrees, less than 310 degrees, less than 330 degrees, or less than 350 degrees, as measured relative to the center of the cup lid 100. The angle ($\alpha_1$) also can be about 250 degrees to about 350 degrees; about 270 degrees to about 330 degrees; or about 265 degrees to about 350 degrees, as measured relative to the center of the cup lid 100.

The inner sidewall 142 of the crown 140 can be generally circular beyond the inner sidewall 162, 164 of the dispensing section 160 (e.g., outside of points A and B). The inner sidewall 142 of the crown 140 also can have a generally straight section 158 that is opposite of the dispensing section 160. The generally circular sections of the inner sidewall 142 can have the same or different curvatures or arcs, depending on the relative locations of the dispensing section 160 and the generally straight section 158 of the crown 140.

For example, a first generally circular section of the inner sidewall 142 can an angle ($\alpha_2$), and a second generally circular section of the inner sidewall 142 can have a curvature or arc with the angle ($\alpha_3$), as depicted in FIG. 5. Both angles ($\alpha_2$) and ($\alpha_3$) are measured relative to the center of the cup lid 100 (e.g., the center of the rim 120). If the generally straight sections 158 and 162 are directly opposing one another and parallel, the angles ($\alpha_2$) and ($\alpha_3$) will be equal or substantially the same.

Each of the angles ($\alpha_2$) and ($\alpha_3$) independently can be about 80 degrees, about 85 degrees, about 90 degrees, about 95 degrees, about 100 degrees, or about 105 degrees to less than about 110 degrees, about 115 degrees, about 120 degrees, about 125 degrees, about 130 degrees, about 140 degrees, or about 150 degrees, as measured relative to the center of the cup lid 100. In some examples, each of the angles ($\alpha_2$) and ($\alpha_3$) independently can be about 80 degrees to about 150 degrees, about 80 degrees to about 130 degrees, about 80 degrees to about 120 degrees, about 80 degrees to about 110 degrees, about 80 degrees to about 100 degrees, about 90 degrees to about 150 degrees, about 90 degrees to about 130 degrees, about 90 degrees to about 120 degrees, about 90 degrees to about 110 degrees, about 90 degrees to about 100 degrees, about 95 degrees to about 150 degrees, about 95 degrees to about 130 degrees, about 95 degrees to about 120 degrees, about 95 degrees to about 110 degrees, or about 95 degrees to about 100 degrees, as measured relative to center of the cup lid 100.

Figure 6:
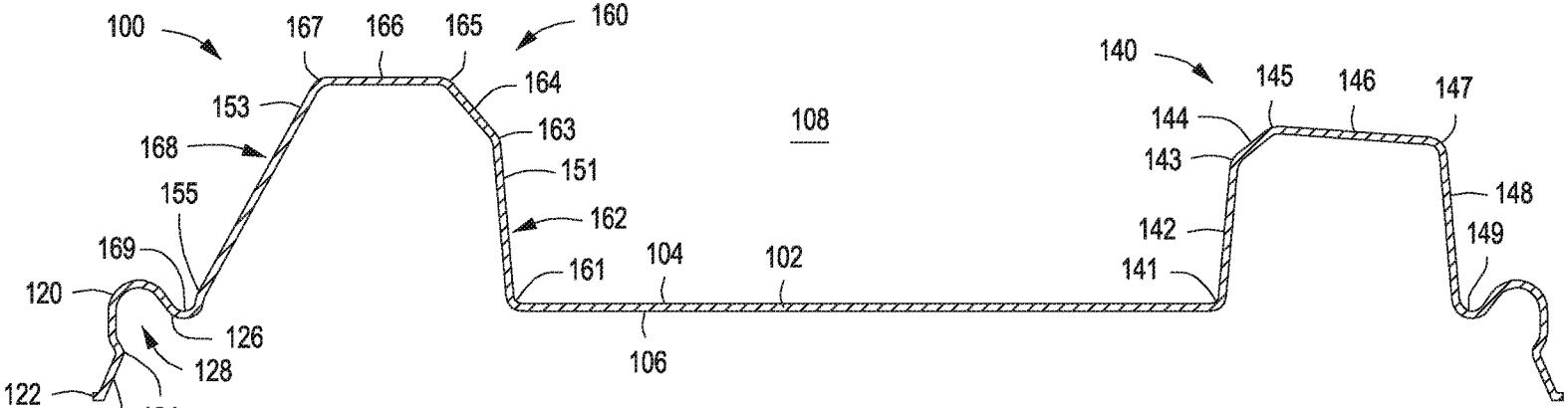
FIG. 6 depicts a cross-sectional view of the cup lid taken along lines 6-6 in FIG. 5.
Figure 7:
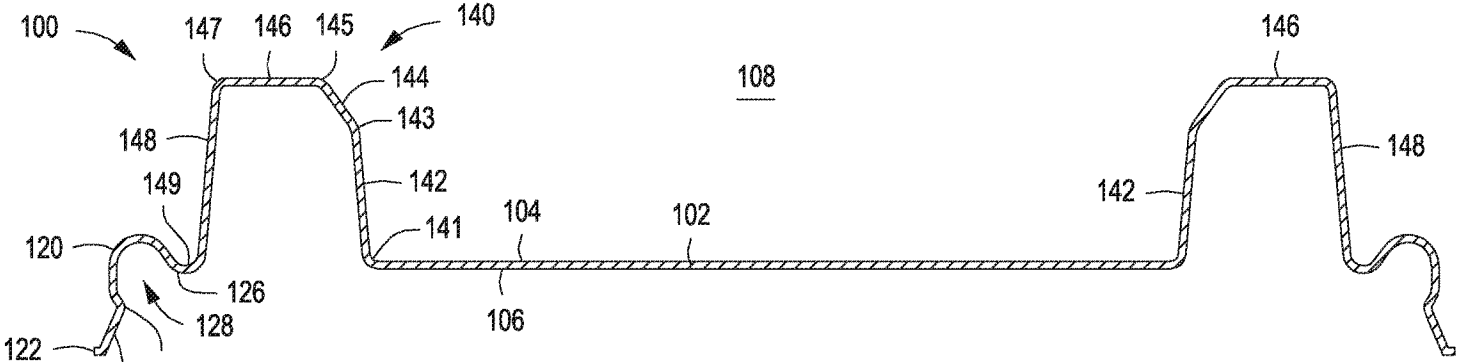
FIG. 7 depicts another cross-sectional view of the cup lid taken along lines 7-7 in FIG. 5.

FIGS. 6 and 7 depict cross-sectional views of the cup lid 100 along lines 6-6 and 7-7 of FIG. 5. Considering the rim 120 in more detail, the rim 120 can include an outer edge or evert 122, an undercut section 123, one or more curved transition sections 124, 126 (two are shown), and a rim snap 128 as further shown in FIGS. 8-9. The rim 120 can have any suitable diameter. The diameter of the rim 120 can be about 5 cm, about 6 cm, about 7 cm, or about 8 cm to about 9 cm, about 10 cm, about 12.5 cm, about 15 cm, or greater. The diameter of the rim 120 can also be about 5 cm to about 10 cm, about 7.5 cm to about 12.5 cm, about 8 cm to about 10 cm, about 9 cm to about 12 cm, or about 10 cm to about 15 cm.

Figure 9:
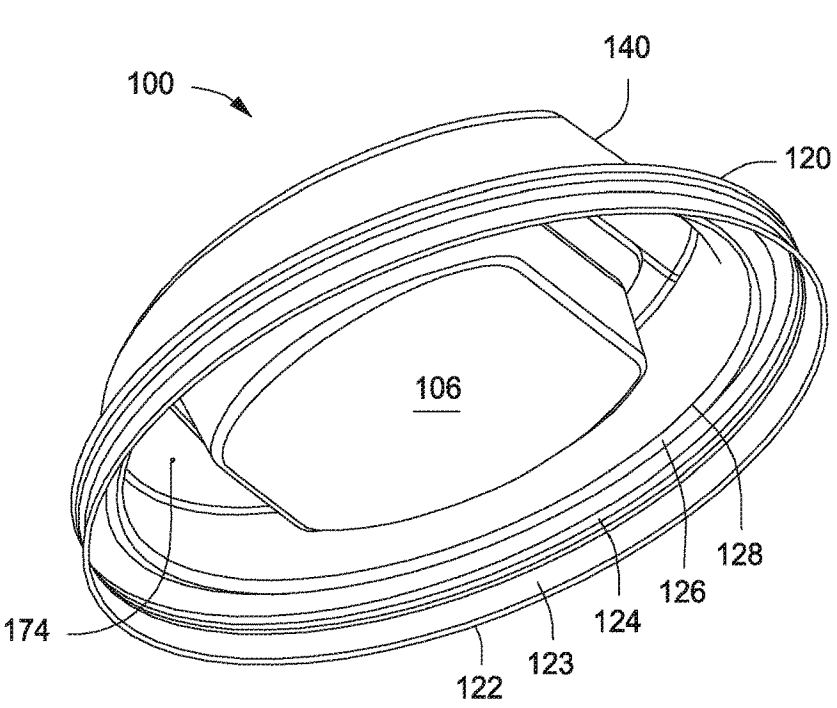
FIG. 9 depicts a perspective bottom view of the cup lid shown in FIG. 1.
Figure 8:
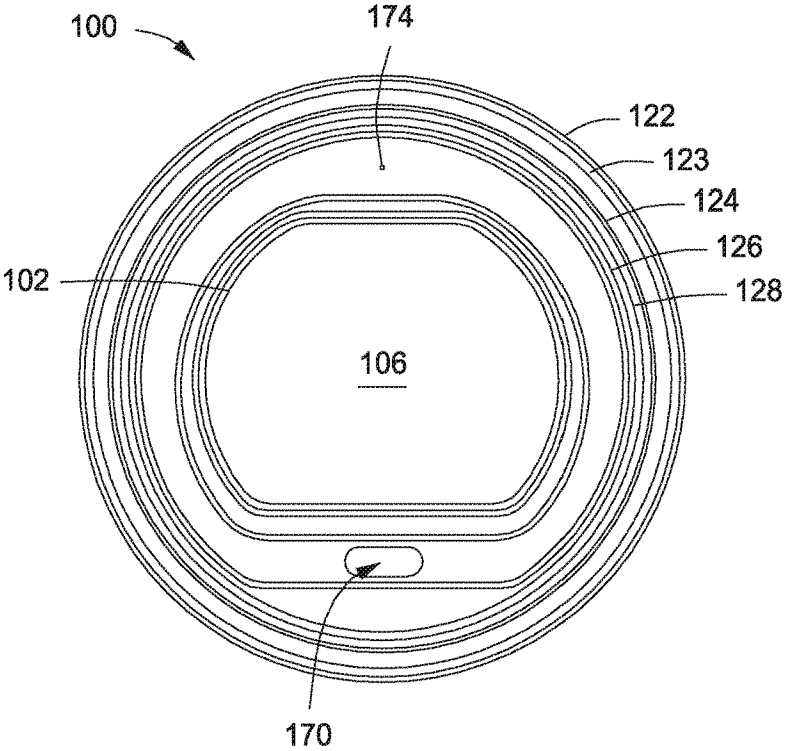
FIG. 8 depicts a bottom view of the cup lid shown in FIG. 1.

The undercut section 123 can be annular and located between the outer edge 122 and the rim snap 128, as further shown in FIGS. 8 and 9. Referring to FIGS. 6-9, the undercut section 123 can be planar and angled from the outer edge 122 to the rim snap 128. The rim snap 128 can be annular and configured to engage or otherwise attach to the ridge of a beverage container. The rim snap 128 can be formed between the curved transition sections 124, 126. The undercut section 123 can be configured to receive a rim on a beverage container, such as a paper cup, and assist at directing or guiding the cup lid 100 onto the beverage container. For example, the undercut section 123 can engage the cup rim and slide along the cup rim until the rim snap 128, including the curved transition sections 124, 126, makes contact with the cup rim. The undercut section 123 can also be used to optimize the nesting of a stack of cup lids 100, as further discussed below.

Referring again to FIGS. 6-7, the base 102 can have an upper surface 104 opposite of a lower surface 106. One or more recessed regions 108 can be defined by the upper surface 104 of the base 102 and the perimeter of the inner sidewall 142 and the inner sidewall 162. The recessed region 108 can provide or serve as a "nose relief" for a user. In other words, the recessed region 108 can be shaped and sized to provide space for a user's nose when the user takes a drink from the drinking aperture 170.

Figure 10:
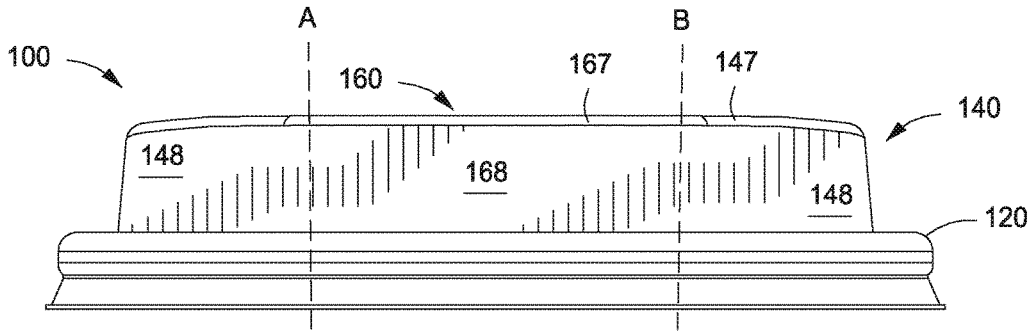
FIG. 10 depicts a front view of the cup lid shown in FIG. 1.
Figure 11:
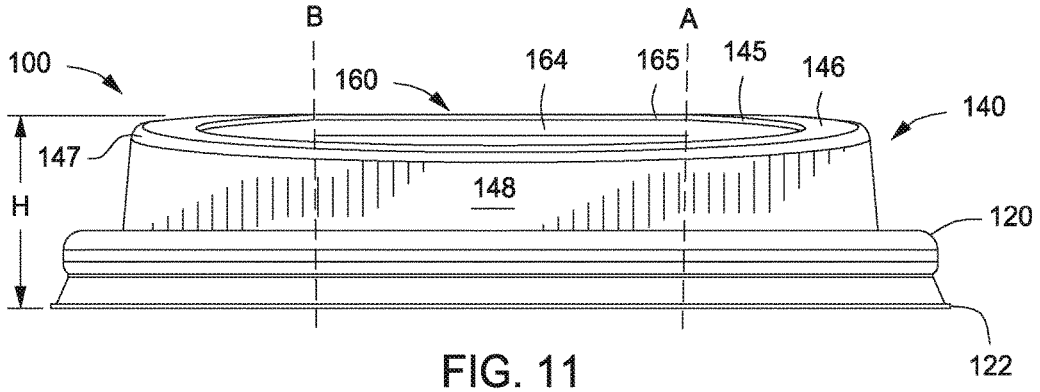
FIG. 11 depicts a rear view of the cup lid shown in FIG. 1.
Figure 12:
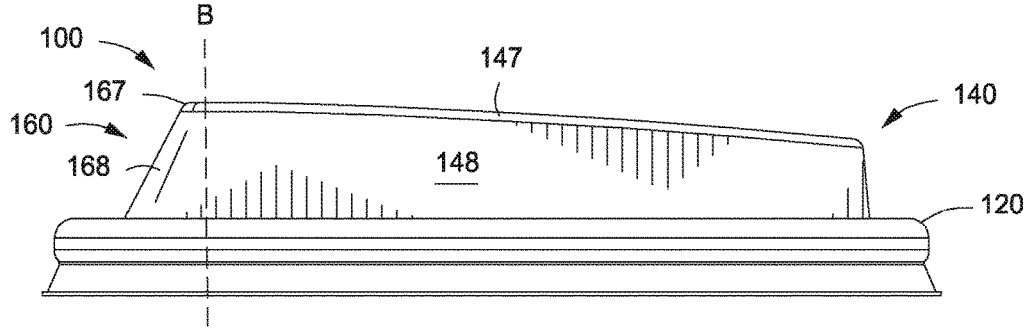
FIG. 12 depicts a side view of the cup lid shown in FIG. 1.

FIGS. 10-12 show various side views of the cup lid 100 shown in FIG. 1 to further illustrate the exterior of the cup lid 100. FIG. 10 depicts a front view of the cup lid 100, FIG. 11 depicts a rear view of the cup lid 100, and FIG. 12 depicts a side view of the cup lid. As shown in FIGS. 10-12, the crown 140 extends upwards from the rim 120, and the dispensing section 160 having the generally straight sidewall portions 164 (FIG. 11) and 168 is located within the crown 140. Lines A and B identify the endpoints of the dispensing section 160. More particularly, line A depicts a transition between the first circular section of the internal wall 142 of the crown 140 and the first end of the dispensing section 160, and line B depicts a transition between a second circular section of the internal wall 142 of the crown 140 and a second end of the dispensing section 160.

The height (H) of the cup lid 100 is identified in FIG. 11. The height (H) of the cup lid 100 can be measured as the vertical distance between the outer edge 122 of the rim 120 and the upper surface 146 of the crown 140 including the upper surface 166 of the dispensing section 160, and can vary about the perimeter of the cup lid 100. The height (H) of the cup lid 100 can be about 2 mm, about 4 mm, about 6 mm, about 8 mm, about 10 mm, or about 12 mm to about 16 mm, about 20 mm, about 24 mm, or greater. The height (H) of the cup lid 100 also can range from a low value of about 2 mm to about 6 mm to a high value of about 10 mm to about 14 mm. Alternatively, the height (H) of the cup lid 100 also can range from a low value of about 8 mm to about 12 mm to a high value of about 16 mm to about 24 mm.

FIGS. 13-17 depict various views of illustrative removable labels (five are shown 190, 290, 390, 490, 590) that can be adhered, attached, or otherwise disposed on a cup lid, including the cup lid 100 described herein, for covering the drinking aperture 170 or sip hole and the surrounding area, such as the area that would be in contact with a consumer's mouth and lips when drinking. The removable labels 190, 290, 390, 490, 590 can protect the area surrounding the drinking aperture 170 from contaminants and when removed, can provide a hygienic surface for the consumer's mouth and lips when drinking. The removable labels can be applied to the cup lid 100 or any other suitable cup lid at the time of manufacture and therefore can shield the mouth/lip area of the cup lid 100 from exposure to contaminants during transit, storage, and beverage service prior to use by the beverage consumer. The removable labels 190, 290, 390, 490, 590 can also reduce or prevent contaminants from passing through the drinking aperture 170. As the removable labels can be easily removed to drink from the cup lid 100, the labels can be re-attached to the lid between sips. The adhesive may be selected to allow for reattachment of the removable label or one time adherence. The adhesive also may be selected to allow for removal or reattachment of the removable label without removing the lid from the cup, damaging the lid or tearing the label apart.

The removable labels 190, 290, 390, 490, 590 can have a barrier section 192 and a pull tab 194 disposed on at least one side of the barrier section 192. The removable labels 190, 290, 390, 490, 590 also can have one or more holes 196 formed or otherwise defined in the barrier section 192. The removable labels 190, 290, 390, 490, 590 can also include one or more adhesives disposed on at least a portion of the surface of the barrier section 192 that can contact and adhere to the cup lid 100.

The pull tab 194 can be any suitable location on the removable label 190. FIGS. 13-17 depict five illustrative configurations for placement of the pull tab 194 although any number of other configurations are contemplated. FIG.

13 depicts the removable label 190 having the pull tab 194 centered on the bottom of the removable label 190. FIG. 14 depicts the removable label 290 having the pull tab 194 centered on the bottom of the label 290. FIG. 15 depicts the removable label 390 having the pull tab 194 centered on the top of the label 390. In these centered configurations depicted in FIGS. 13-15, the pull tab 194 can be easily located over the dispensing section 160 of the cup lid 100 without looking and is easy to remove regardless of the user's dominant hand. FIG. 16 depicts the removable label 490 having the pull tab 194 on the bottom left. FIG. 17 depicts the removable label 590 having the pull tab 194 on the bottom right.

Any of the labels depicted in FIGS. 13-17 can include one or more notches 191 (two are shown) formed adjacent any periphery thereof, in any pattern or frequency. One illustrative embodiment is depicted in FIG. 14 with reference to label 290; however, it should be appreciated that the notch(es) 191 can used with any label 190, 290, 390, 490, 590. The notch(es) can facilitate the application of the label (i.e. help with positioning). The notch(es) also can allow the label to bend or flex at any angle, bend, or transition to match that on the surface of the cup lid 100.

The removable labels provide the following: (a) sufficient adhesion to the lid over the handling, storage, and service of the product until the beverage is ready for consumption by the consumer; (b) appropriate adhesion that allows the label to be removed from the lid without removing the lid from the cup, damaging the lid or tearing the label apart; (c) removal of the label without leaving a sticky residue on the lid that could result in adherence of contaminants or sticking to the lips; (d) sufficient tackiness to reattach the label to any portion of the cup lid two, three, or more times; and (e) sufficiently high service temperature to insure the label laminate and adhesive remain integral once exposed to the elevated temperatures of hot cup beverages which includes removal of the label without delamination.

The removable labels can be or can include one or more pressure-sensitive substrates and/or laminates. For example, the removable labels 190, 290, 390, 490, 590 can be constructed of or otherwise can include a release liner, a face stock, and an adhesive disposed therebetween. Suitable adhesives can be one or more pressure sensitive adhesives, and can contain one or more emulsion acrylics and/or one or more solvent acrylics.

The removable labels 190, 290, 390, 490, 590 further can include one or more release liners that can adhere to and cover the adhesive layer and can readily release during manufacture for subsequent discarding. Suitable release liners can include treated paper (e.g., silicone coating) or thin film that can be removed in the finished product application. In other examples, the removable labels are "linerless" labels, meaning they have no such release liner.

The removable labels 190, 290, 390, 490, 590 can be transparent or opaque and can be colorless or have one or more colors. For example, the removable labels can be transparent and colorless, transparent and colored with one or more colors, or opaque and colored with one or more colors. The face stocks of the removable labels can be or can include one or more flexible films. Suitable flexible films can be or can include one or more biaxial polypropylene, polyethylene terephthalate (PET), polyolefins, polyolefin blends, or other suitable polymers, plastics, paper, or any combination thereof. The face stock can be colorless or colored, transparent or opaque, and/or can have print to customize the visual aesthetics or reinforce customers' branding. If printing is desired, a topcoat can be applied to the face stock so the surface can readily receive and bind the print inks.

The pull tab 194 can extend away from the lid surface to easily remove the removable label 190. At least a portion of the pull tab 194 is preferably not adhered or otherwise attached to the lid surface to facilitate removal of the removable label 190 from the cup lid. It is preferable to avoid application of the adhesive to the pull tab 194 to provide the pull tab 194 free of the adhesive. Alternatively, if adhesive is applied to the pull tab 194, the adhesive in at least a portion of the pull tab 194 can be rendered non-tacky and non-adherent. This can be accomplished in a variety of ways, such as leaving release liner attached in the area of the pull tab 194 or by applying a deadener coating over the adhesive. Silicone coating is one of various chemical coatings that can be used to deaden the adhesive in the area of the pull tab 194. To make the pull tab 194 visibly obvious against the lid underneath, the face stock can be printed in this area with text, indicia or a full color coating using a print ink. Color may also be imparted to the pull tab 194 by adding a color agent to the deadener coating or printing the facestock in this region, thereby imparting color in one manufacturing step.

The removable labels can be or can include a label substrate that is commercially available, such as from Avery Dennison, MACtac, and UPM Raflatac. Such suitable labels are SELECT SOLUTION® 78860 and 79249 that are commercially available from Avery Dennison; Peal-Reseal Adhesive RDT14105 that are commercially available from MACtac; and the SP401W removable labels commercially available from UPM Raflatac.

The removable labels can have a length (L) and a width (W), as depicted in FIGS. 13-17. The removable labels can have any suitable length (L) and width (W). In one embodiment, the removable labels can have a length (L) and width (W) that correspond to the length and width of the generally straight portions 151, 153, 164 of the dispensing section 160. The length (L) and width (W) of the removable label can be bigger or smaller than the dispensing section 160. In some embodiments, the length (L) of the adhesive labels can be about 1 cm, about 1.5 cm, about 2 cm, about 2.5 cm, or about 3 cm to about 3.5 cm, about 4 cm, about 4.5 cm, about 5 cm, about 5.5 cm, about 6 cm, or greater. The length (L) of the adhesive labels also can be about 1 cm to about 6 cm, about 1 cm to about 5.5 cm, about 2 cm to about 5.5 cm, about 3 cm to about 5.5 cm, about 3.5 cm to about 5.5 cm, about 4 cm to about 5.5 cm, about 4.5 cm to about 5.5 cm, about 1 cm to about 5 cm, about 2 cm to about 5 cm, about 3 cm to about 5 cm, about 3.5 cm to about 5 cm, about 4 cm to about 5 cm, about 4.5 cm to about 5 cm, about 2 cm to about 4 cm, or about 3 cm to about 4 cm. The width (W) of the adhesive labels can be about 1 cm, about 1.5 cm, about 2 cm, about 2.5 cm, or about 3 cm to about 3.5 cm, about 4 cm, about 4.5 cm, about 5 cm, about 5.5 cm, about 6 cm, or greater. The width (W) also can be about 1 cm to about 6 cm, about 1 cm to about 5 cm, about 2 cm to about 5 cm, about 3 cm to about 5 cm, about 3.5 cm to about 5 cm, about 4 cm to about 5 cm, about 4.5 cm to about 5 cm, about 1 cm to about 4 cm, about 2 cm to about 4 cm, about 3 cm to about 4 cm, about 3.5 cm to about 4 cm, about 2.5 cm to about 4 cm, or about 2.5 cm to about 3.5 cm.

Figure 18:
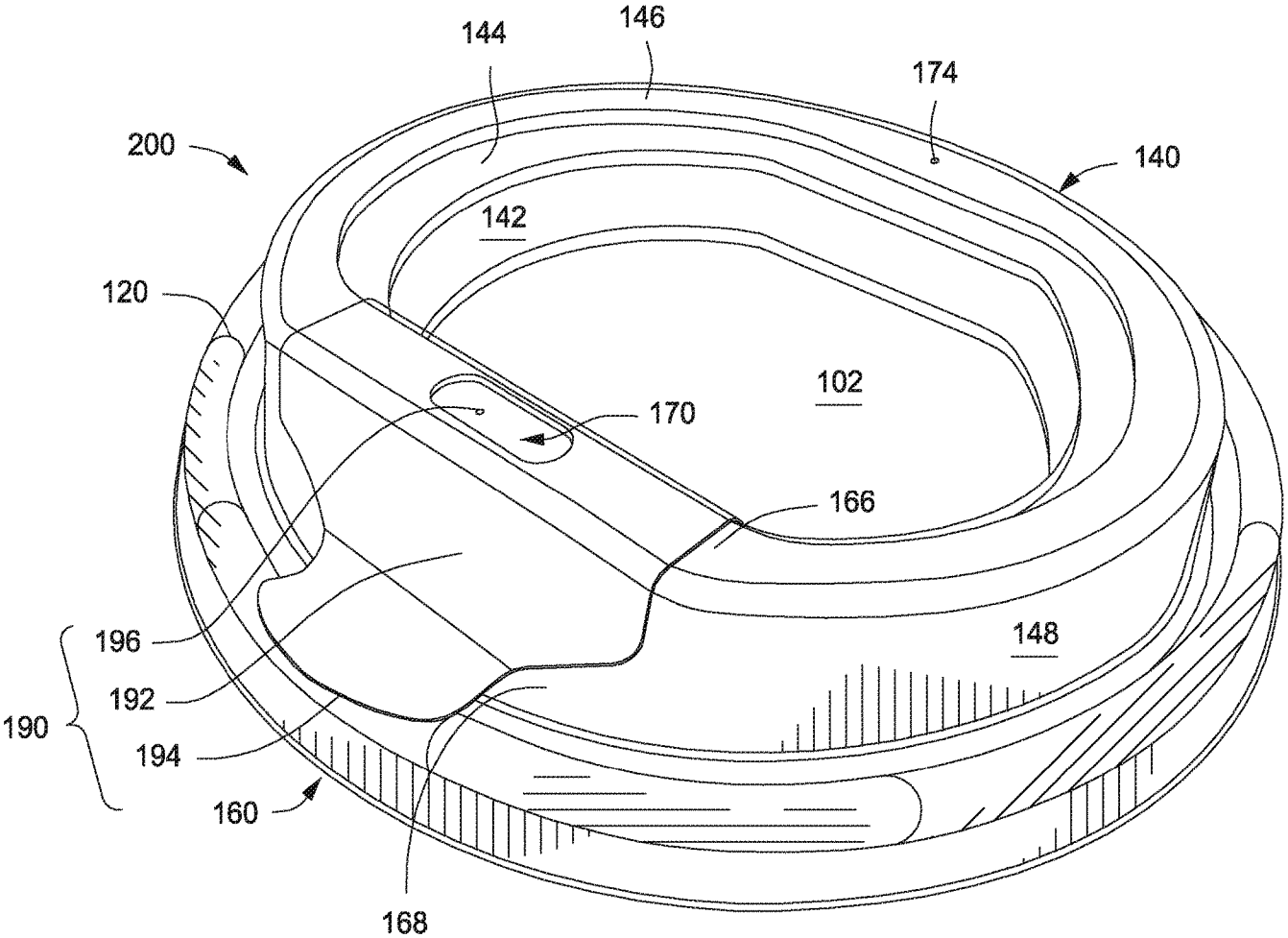
FIG. 18 depicts a top perspective view of an illustrative cup lid containing the label shown in FIG. 13 disposed over at least a portion of its dispensing section, according to one or more embodiments described.
Figure 19:
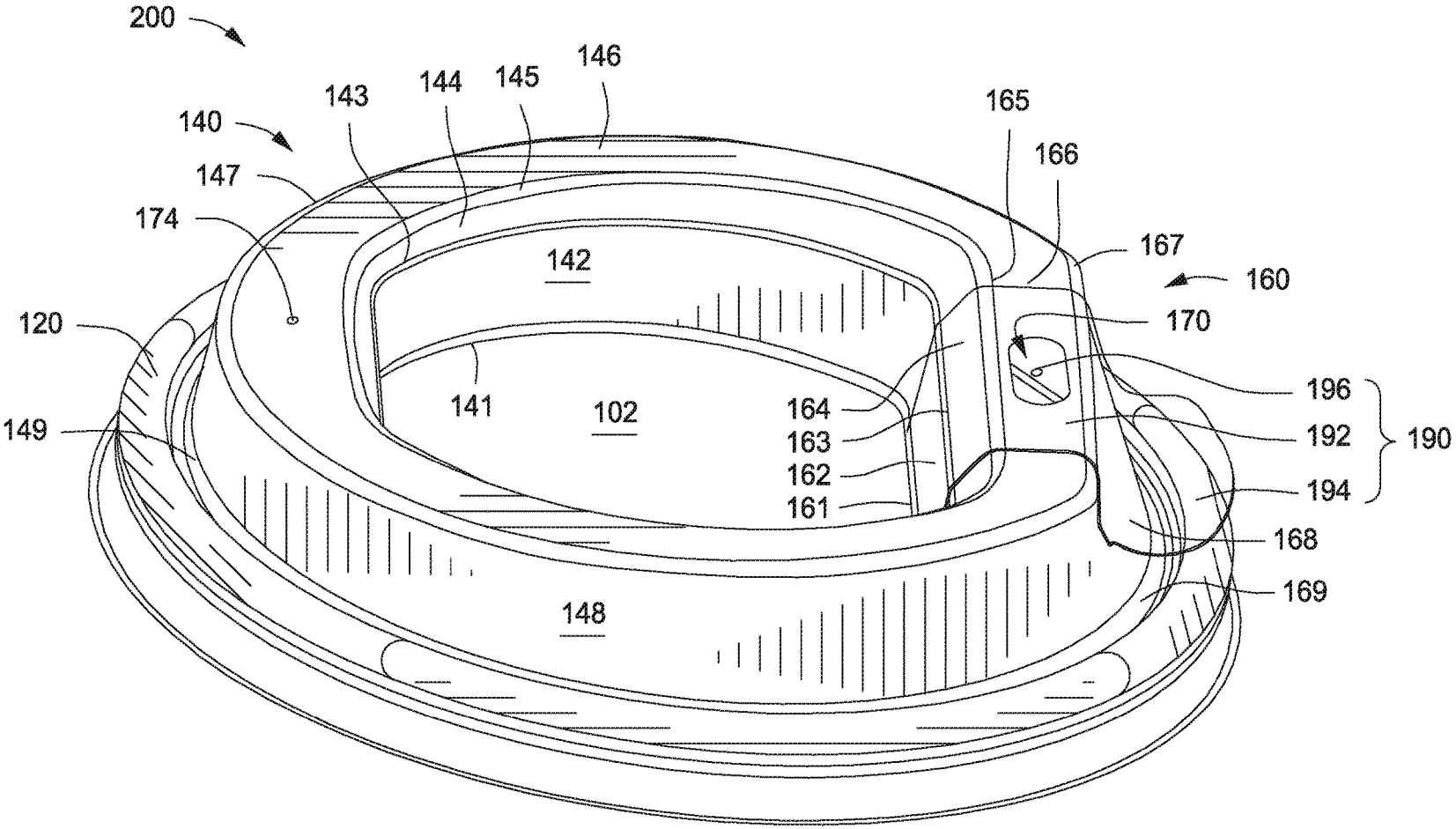
FIG. 19 depicts another perspective view of the cup lid shown in FIG. 18.
Figure 20:
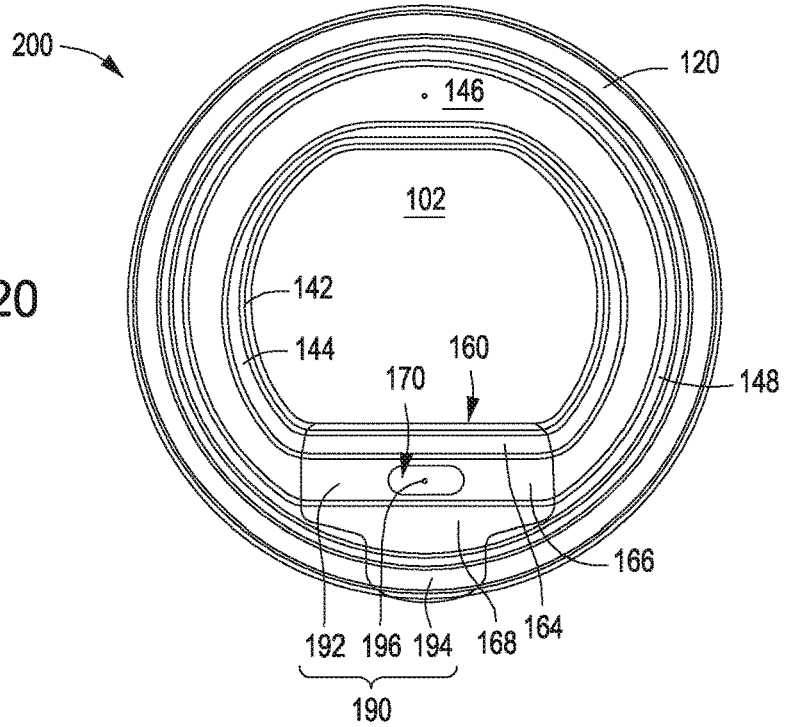
FIG. 20 depicts a top view of the cup lid shown in FIG. 18.
Figure 21:
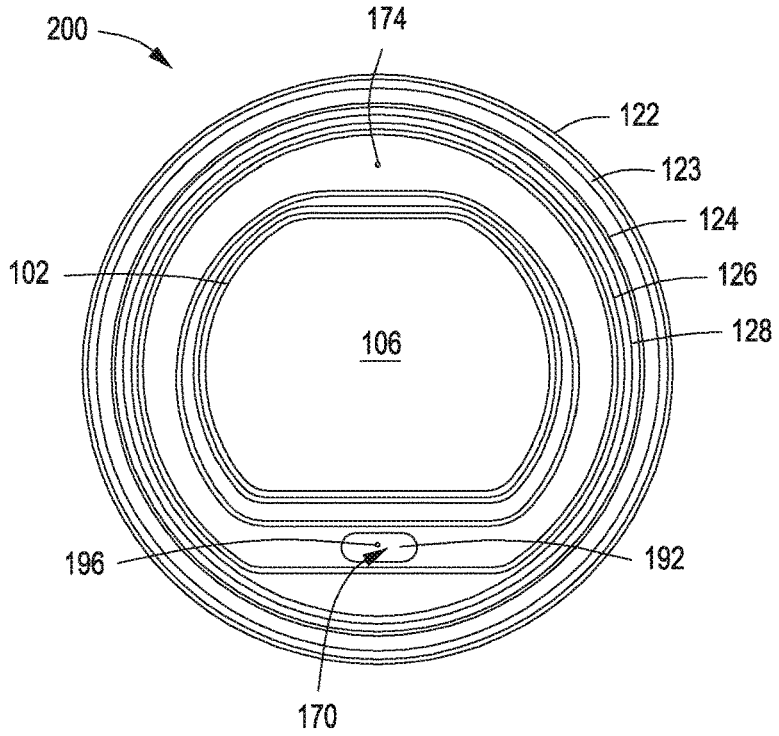
FIG. 21 depicts a bottom view of the cup lid shown in FIG. 18.
Figure 22:
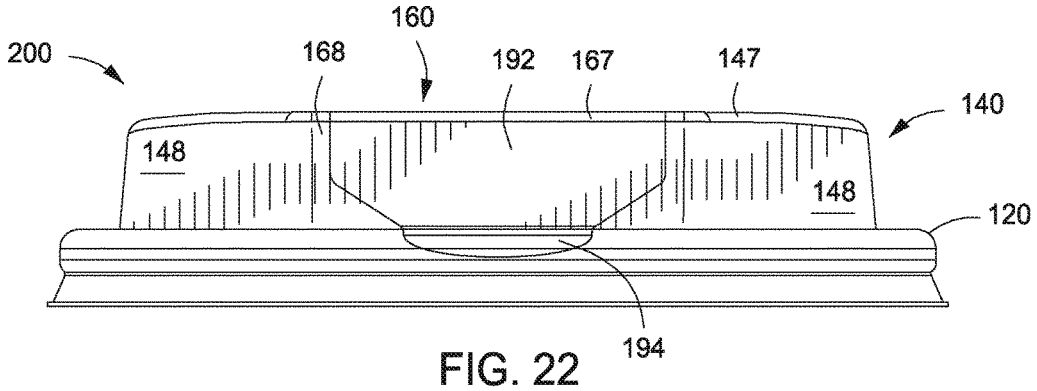
FIG. 22 depicts a front view of the cup lid shown in FIG. 18.
Figure 23:
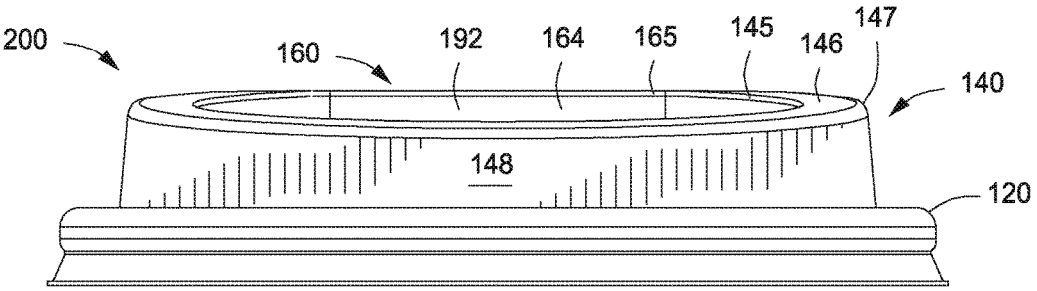
FIG. 23 depicts a rear view of the cup lid shown in FIG. 18.
Figure 24:
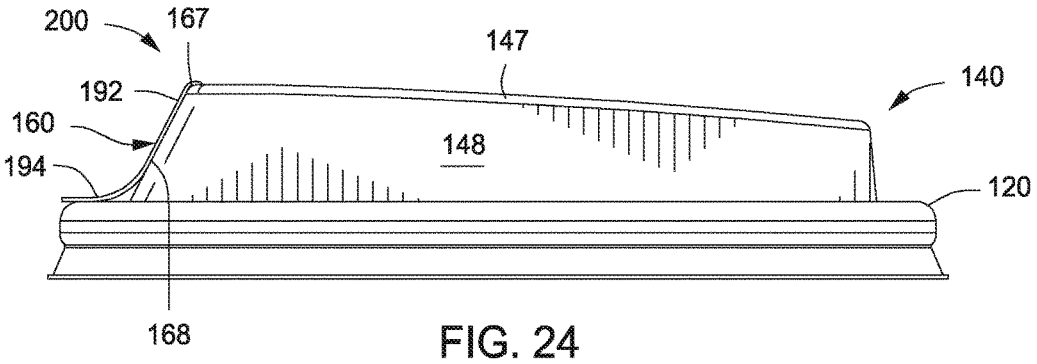
FIG. 24 depicts a side view of the cup lid shown in FIG. 18.
Figure 25:
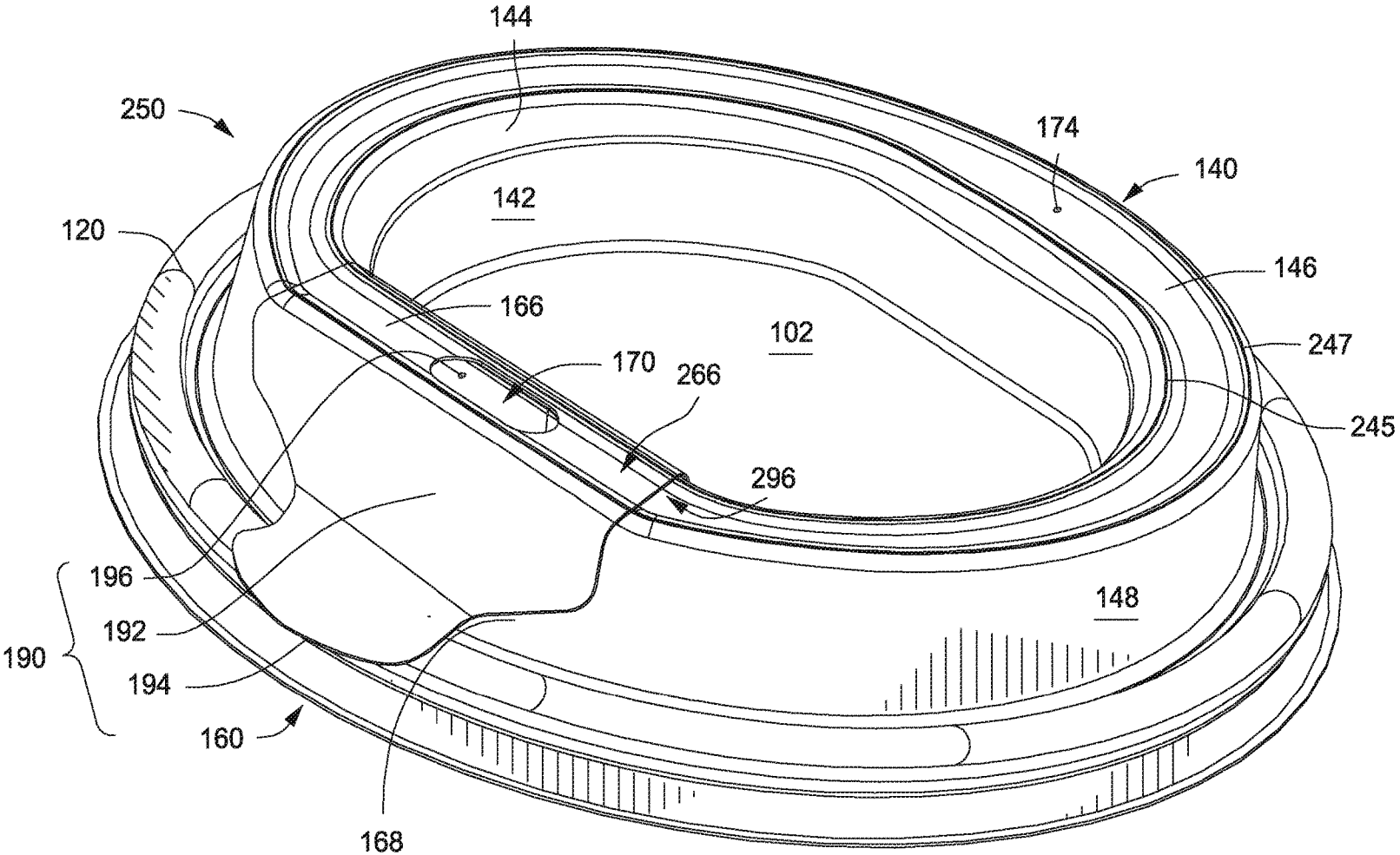
FIG. 25 depicts a top perspective view of another illustrative cup lid with a label disposed over its dispensing section, according to one or more embodiments described.
Figure 26:
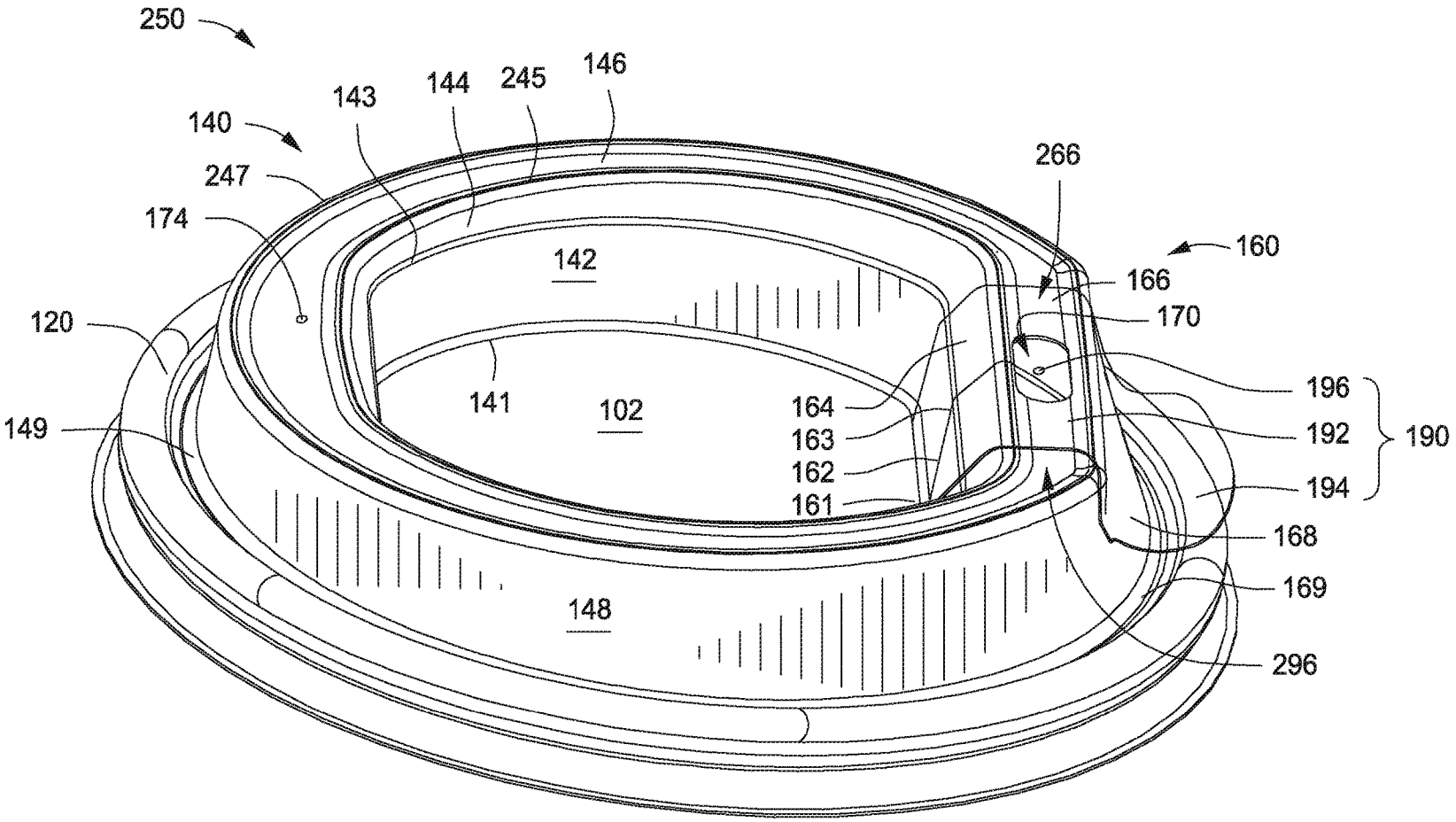
FIG. 26 depicts another perspective view of the cup lid shown in FIG. 25.
Figure 27:
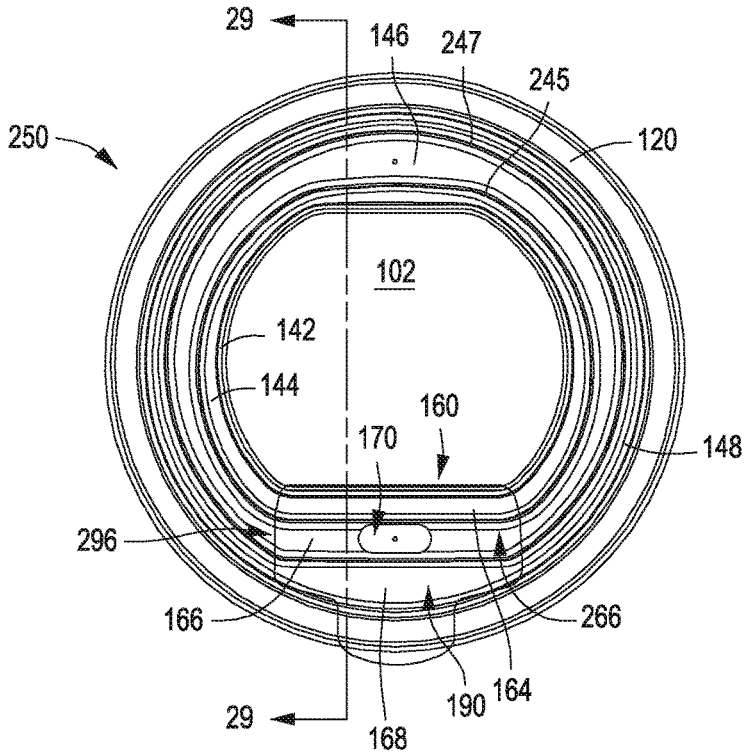
FIG. 27 depicts a top view of the cup lid shown in FIG. 25.
Figure 28:
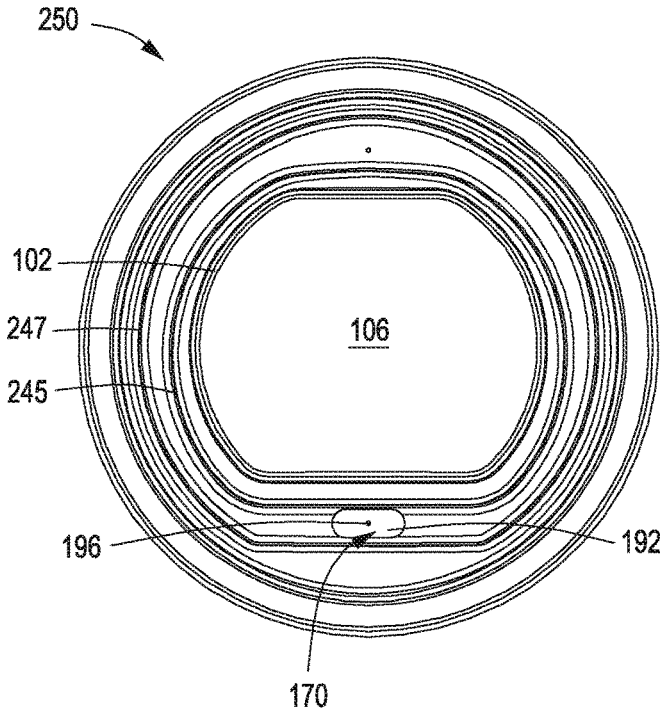
FIG. 28 depicts a bottom view of the cup lid shown in FIG. 25.
Figure 29:
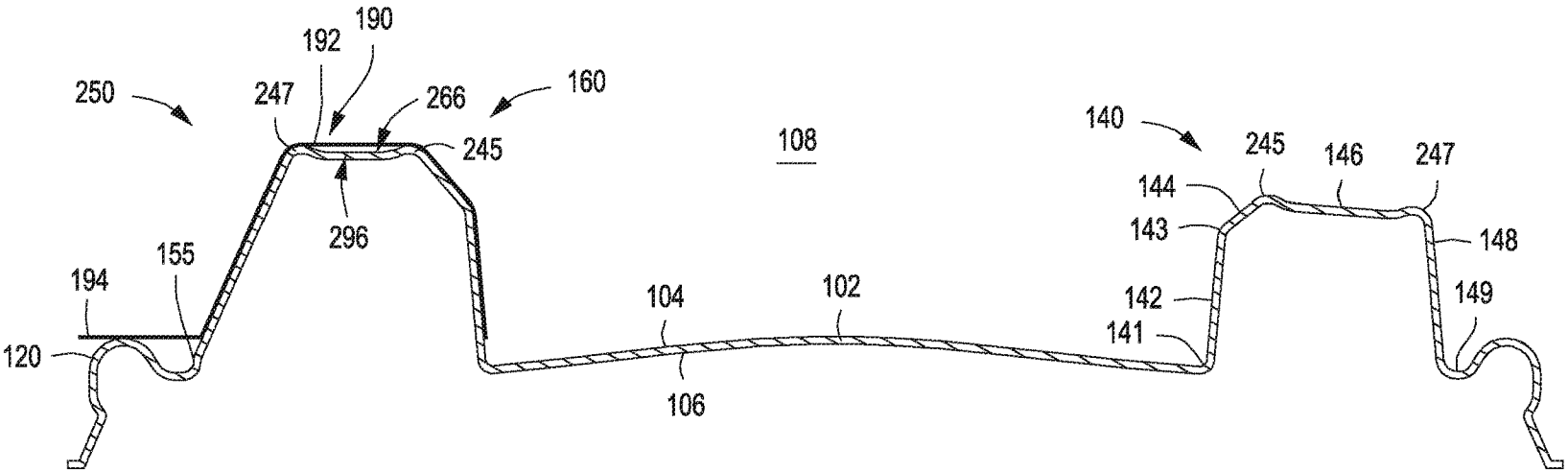
FIG. 29 depicts a cross-sectional view of the cup lid taken along lines 29-29 in FIG. 27.
Figure 30:
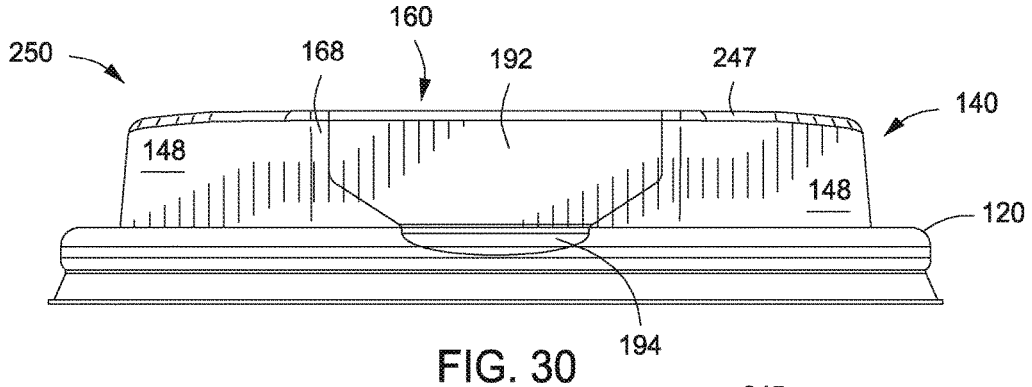
FIG. 30 depicts a front view of the cup lid shown in FIG. 25.
Figure 31:
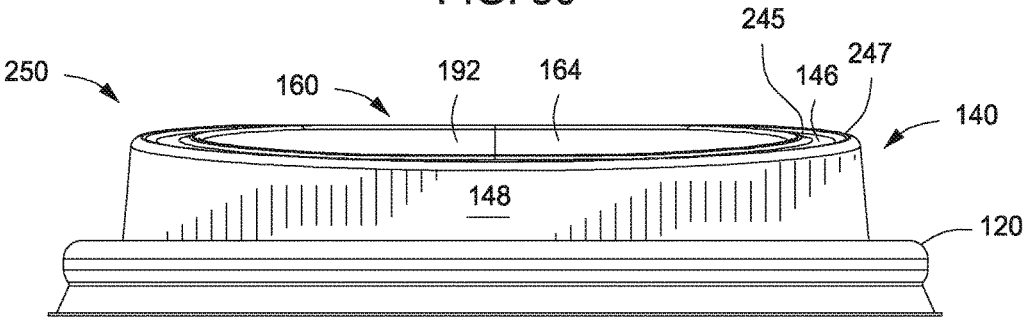
FIG. 31 depicts a rear view of the cup lid shown in FIG. 25.
Figure 32:
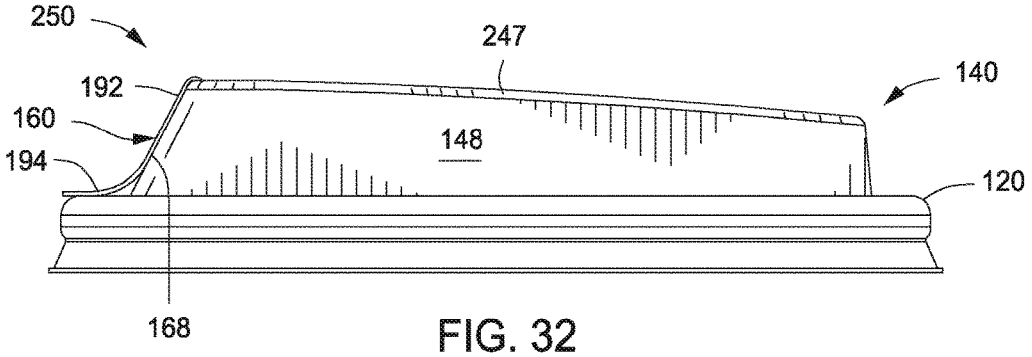
FIG. 32 depicts a side view of the cup lid shown in FIG. 25.

FIGS. 18-24 depict various perspective views of a cup lid 200 having the removable label 190 disposed thereon, according to one or more embodiments described herein. FIGS. 18 and 19 depict top perspective views of the cup lid 200 with the removable label 190 disposed thereon. FIGS. 20 and 21 depict top and bottom views, respectively, of the cup lid 200 and the removable label 190 of FIG. 18. FIG. 22-24 depict front, back, and side views, respectively, of the cup lid 200 and the removable label 190. As depicted, the removable label 190 is adhered or otherwise disposed over at least a portion of the dispensing section 160 including the drinking aperture 170. It should be readily understood that any of the removable labels 290, 390, 490, 590 described herein can be substituted for the removable label 190 and placed on any cup lid configuration. For simplicity and ease of illustration, however, the embodiments of the invention will be further described with reference to the configuration of the removable label 190 disposed on cup lid 200, which is similar to the cup lid 100 described herein.

Referring to FIGS. 18-24, the removable label 190 can be disposed over the drinking aperture 170 and adhered to at least the upper surface 166 of the dispensing section 160. The removable label 190 can also be adhered to the inner sidewall 162, the outer sidewall 168, or both sidewalls 162, 168. Depending on the pattern of the adhesive applied to the label 190, the removable label 190 can be adhered to the inner sidewall 162 and the outer sidewall 168, but not the upper surface 166, or any other combination of surfaces. The removable label 190 also can be adhered to the inner sidewall 162, the transition section 163, the beveled inner surface 164, the transition section 165, the upper surface 166, the transition section 167, and the generally straight outer sidewall 168, as depicted in the figures. Regardless of where the label 190 adheres to the surfaces of the dispensing section 160, so long as the label remains in place, the underlying area of the dispensing section 160, also known as the mouth/lip area, disposed under the removable label 190 will be better protected from contamination.

The hole 196 of the removable label 190 can be aligned with or otherwise disposed over and in fluid communication with the drinking aperture 170, as depicted in FIGS. 18-21. The hole 196 can be any size or cross section suitable to allow the passage of fluids, including gases and liquids, therethrough. The hole 196 can allow the passage of fluids through the label 190, including air as well as the beverage in a cup or other container attached to the cup lid 200. By allowing air to pass through the label 190, the lids can be more tightly stacked.

Furthermore, the generally straight surfaces of the dispensing section 160 facilitate the application and removal of the removable label 190. The generally straight surfaces provide flat surfaces that provide increased surface area for the label to adhere to. The generally straight surfaces significantly improve contact with the label, and are much better than rounded or curved contact surfaces. The generally straight surfaces further significantly improve aesthetics by significantly reducing, if not eliminating, the label from folding or buckling. As such, the label is able to lay flat on the lid, creating a lid with improved ability to stack (e.g. "nest") for a more dense (e.g. compact) stack of lids when stacked. A more compact stack of lids improves stack stability, and allows the lids to readily separate (e.g. "de-nest") for dispensing. The generally straight surfaces further significantly decrease the costs of manufacturing. Because of the generally straight surfaces, the label can be applied using an automated label applicator during the manufacturing of the lid. This reduces manufacturing time, manufacturing costs, and significantly improves the lid's cleanliness and hygiene.

FIGS. 25-32 depict various perspective views of another cup lid 250 having the removable label 190 disposed over at least a portion of its dispensing section 160, according to one or more embodiments described. As shown, the cup lid 250 can include at least one raised edge or ridge (two are shown, inner and outer ridges 245, 247) that extends upwardly from the upper surface 146 of the crown 140, including the upper surface 166 of the dispensing section 160. When two ridges 245, 247 are used, a recessed area 266 is formed therebetween. The recessed area 266 can provide a void or air gap 296 when a label, including any of the removable labels described herein, is adhered or otherwise placed onto the dispensing section 160. This void or air gap 296 can allow the beverage within a cup to breathe or cool, all while the label protects the drinking section 160 of the cup lid 250 from contamination. The void or air gap 296 also can provide a passageway that allows fluids, such as air or the beverage with in a cup, to flow. The void or air gap 296 facilitates stacking of the lids by allowing air under the removable label to escape. This provides a more compact stack of lids, improves stack stability, and improves separation for dispensing.

Figure 33:
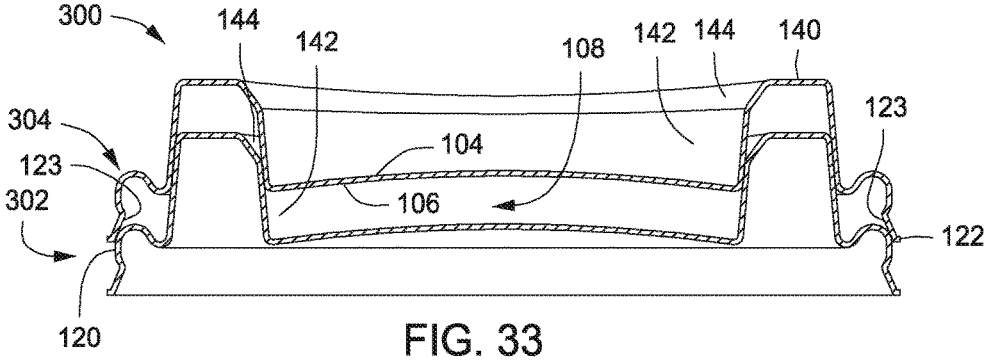
FIG. 33 depicts an illustrative cross-sectional view of two cup lids, according to one or more embodiments described herein, that are stacked on one another.

FIG. 33 depicts a cross-sectional view of an illustrative stack 300 of two cup lids 302, 304 stacked on one another. The cup lids 302, 304 can be or can include one or more cup lids 100, one or more cup lids 200, and/or one or more cup lids 250, as discussed and described herein. Although the stack 300 is depicted with the two cup lids 302, 304, the stack 300 can include any number of the cup lids 100, 200, 250, 302, and 304. For example, the stack 300 can include 2, 3, 4, or 5 lids to 10, 50, 100, 200, 500, or more cup lids.

The undercut section 123 can be used to align the lids 100, 200, 250 when stacking to create a stable stack 300 that readily "de-nests"—without being stuck together—for dispensing lids. The undercut section 123 of an upper cup lid 304 can be configured to engage the rim 120 of a lower cup lid 302 when the upper cup lid 304 is placed on top of the lower cup lid 302. Similarly, the lower surface 106 of the base 102 of the upper cup lid 304 can be configured to engage the beveled inner surface 144 of the lower cup lid 302 when placing the upper cup lid 304 on top of the lower cup lid 302. For example, the beveled inner surface 144 of the lower cup lid 302 can funnel or otherwise direct the lower surface 106 of the upper cup lid 304 when being placed on top of the lower cup lid 302. The undercut section 123 of the upper cup lid 304 and the rim 120 of the lower cup lid 302 can be configured to keep the cup lids 302, 304 mostly separated from each other, e.g., making physical contact at minimum points. Once stacked, the undercut section 123 including the outer edge 122 of the upper cup lid 304 can provide the user with an extended portion of the upper cup lid 304 to grab hold of when lifting away from the lower cup lid 302 and the remaining stack of cup lids.

The cup lids 100, 200, 250, 302, and 304 can be made by thermoforming or any other suitable process. Generally speaking, thermoforming is the pressing and/or stretching of heated deformable material into a final shape. Thermoforming is the draping of a softened sheet over a shaped mold. More particularly, thermoforming is the automatic high speed positioning of a heated sheet having an accurately controlled temperature into a pneumatically actuated forming station whereby the article's shape can be defined by the mold, followed by trimming and regrind collection.

Forming techniques other than thermoforming can also be used to manufacture any of the cup lids 100, 200, 250, 302, and 304 disclosed herein. These include variations such as pre-softening the extruded sheet to temperatures below the final melting temperature, cutting flat sections (i.e., blanks) from the sheet, transfer of blanks by gravity or mechanical means into matched molds whereby the blanks are shaped into the article by heat and pressure. Still other alternative arrangements include the use of drape, vacuum, pressure, free blowing, matched die, billow drape, vacuum snap-back, billow vacuum, plug assist vacuum, reverse draw with plug assist, pressure bubble immersion, trapped sheet, slip, diaphragm, twin-sheet cut sheet, twin-sheet rolled forming and suitable combinations of the above. Suitable alternate arrangements can also include a pillow forming technique which creates a positive air pressure between two heat softened sheets to inflate them against a clamped male/female mold system to produce a hollow product. Metal molds are etched with patterns ranging from fine to coarse to simulate a natural or grain like texturized look. Suitable formed articles can be trimmed in line with a cutting die with the trimmings being optionally reused. Other arrangements for productivity enhancements include the simultaneous forming of multiple articles with multiple dies in order to maximize throughput and minimize scrap.

Thermoplastic materials are intended to encompass materials suitable for thermoplastic molding of disposable cup lids. A material suitable for the lid can be or can include one or more styrene polymer compositions, which can be filled or unfilled. The composition can have enough pigment to provide opacity or near opacity. Other suitable materials can include, but are not limited to, one or more polyolefins such as polyethylenes, polypropylenes, mixtures of polyethylenes and polypropylenes, polylactic acids or polylactide (PLA), polyesters, polyamides, polyacrylates, polysulfones, polyetherketones, polycarbonates, acrylics, polyphenylene sulfides, acetyls, cellulosics, polyether imides, polyphenylene ethers/oxides, styrene maleic anhydride copolymers, styrene acrylonitrile copolymers, polyvinyl chlorides, or any mixture thereof. These materials can be or can include filled polymeric materials and/or unfilled polymeric materials. The filled polymeric materials can include one or more types of fillers.

Embodiments described herein further relate to any one or more of the following paragraphs:

1. A disposable cup lid for use with a beverage container, comprising: a base; an annular rim disposed about the base and configured to engage the beverage container; a crown extending upward from at least a portion of the base, wherein the crown comprises an upper surface, an inner sidewall, and an outer sidewall; a dispensing section located within a portion of the crown, wherein the dispensing section comprises an upper surface, an inner sidewall, and an outer sidewall, wherein a generally straight portion of the inner sidewall of the dispensing section opposes a generally straight portion of the outer sidewall of the dispensing section; and a drinking aperture formed through the upper surface of the dispensing section to allow fluid to pass therethrough.

2. A disposable cup lid for use with a beverage container, comprising: an annular rim configured to engage the beverage container; a crown extending upward from at least a portion of the annular rim, wherein the crown comprises an upper surface, an inner sidewall, and an outer sidewall; a dispensing section located within a portion of the crown, wherein the dispensing section comprises an upper surface, an inner sidewall, and an outer sidewall, wherein a generally straight portion of the inner sidewall of the dispensing section opposes a generally straight portion of the outer sidewall of the dispensing section; and a drinking aperture formed through the upper surface of the dispensing section to allow fluid to pass therethrough, wherein a first section of the outer sidewall of the crown is generally circular having an arc with an angle of about 270 degrees to about 330 degrees centered with the annular rim and a second section of the outer sidewall of the crown comprises the generally straight portion of the outer sidewall of the dispensing section, and wherein the inner sidewall of the crown comprises two generally circular sections having a common center separated by two generally straight sections, and wherein each of the generally circular sections of the inner sidewall of the crown has an arc with an angle of about 90 degrees to about 130 degrees centered with the annular rim.

3. A disposable cup lid for use with a beverage container, comprising: an annular rim configured to engage the beverage container; a crown extending upward from at least a portion of the annular rim, wherein the crown comprises an upper surface, an inner sidewall, and an outer sidewall; a dispensing section located within a portion of the crown, wherein the dispensing section comprises an upper surface, an inner sidewall, and an outer sidewall, wherein a generally straight portion of the inner sidewall of the dispensing section opposes a generally straight portion of the outer sidewall of the dispensing section; and a drinking aperture formed through the upper surface of the dispensing section to allow fluid to pass therethrough, wherein: a first section of the outer sidewall of the crown is generally circular and centered with the annular rim and a second section of the outer sidewall of the crown comprises the generally straight portion of the outer sidewall of the dispensing section, the inner sidewall of the crown comprises two generally circular sections centered with the annular rim separated by two generally straight sections, each of the two generally circular sections of the inner sidewall of the crown has an arc with an angle of greater than 90 degrees, the two generally straight sections of the inner sidewall of the crown are generally parallel in at least one dimension, and one of the two generally straight sections of the inner sidewall of the crown comprises the generally straight portion of the inner sidewall of the dispensing section.

4. The disposable cup lid according to any one of paragraphs 1-3, wherein the outer sidewall of the dispensing section is nearer the annular rim and the inner sidewall of the dispensing section is nearer the base.

5. The disposable cup lid according to any one of paragraphs 1-4, wherein the generally straight portion of the inner sidewall of the dispensing section is perpendicular to the annular rim.

6. The disposable cup lid according to any one of paragraphs 1-5, wherein the generally straight portion of the outer sidewall of the dispensing section is angled from a lower end of the dispensing section toward the upper surface of the dispensing section.

7. The disposable cup lid according to any one of paragraphs 1-6, wherein a first transition between the generally straight portion of the inner sidewall and the upper surface of the dispensing section is generally parallel in at least one dimension with a second transition between the generally straight portion of the outer sidewall and the upper surface of the dispensing section.

8. The disposable cup lid according to any one of paragraphs 1-7, wherein the upper surface of the dispensing section has a length of about 20 mm to about 60 mm and a width of about 2 mm to about 10 mm, wherein the length of the upper surface is defined by the length of the outer sidewall of the dispensing section, and wherein the width of the upper surface is defined between the inner sidewall and the outer sidewall of the dispensing section.

9. The disposable cup lid according to any one of paragraphs 1-8, wherein the dispensing section further comprises an transition between the annular rim and the outer sidewall of the dispensing section, and wherein the dispensing section further comprises an transition between the inner sidewall and the upper surface of the dispensing section.

10. The disposable cup lid according to any one of paragraphs 1-9, wherein the dispensing section further comprises an transition between the inner sidewall and the upper surface of the dispensing section.

11. The disposable cup lid according to any one of paragraphs 1-10, further comprising a recessed region defined by the base and the inner sidewall of the crown, and wherein the inner sidewall of the crown and the outer sidewall of the crown are generally circular on either side of the dispensing section.

12. The disposable cup lid according to any one of paragraphs 1-11, wherein the outer sidewall of the crown is generally circular having an arc with an angle of greater than 250 degrees and less than 350 degrees centered with the annular rim.

13. The disposable cup lid according to any one of paragraphs 1-12, wherein a first section of the outer sidewall of the crown is generally circular having an arc with an angle of about 270 degrees to about 330 degrees centered with the annular rim and a second section of the outer sidewall of the crown comprises the generally straight portion of the outer sidewall of the dispensing section.

14. The disposable cup lid according to any one of paragraphs 1-13, wherein the inner sidewall of the crown comprises two generally circular sections having a common center separated by two generally straight sections, wherein each of the generally circular sections of the inner sidewall of the crown has an arc with an angle of about 90 degrees to about 130 degrees centered with the annular rim.

15. The disposable cup lid according to any one of paragraphs 1-14, wherein the inner sidewall of the crown is angled from the base toward the upper surface of the crown, and wherein the outer sidewall of the crown is angled from the annular rim toward the upper surface of the crown.

16. The disposable cup lid according to any one of paragraphs 1-15, wherein the crown further comprises a beveled inner surface between the upper surface of the crown and the inner sidewall of the crown.

17. The disposable cup lid according to any one of paragraphs 1-16, further comprising a removable label disposed over the drinking aperture and at least a portion of the dispensing section.

18. The disposable cup lid according to any one of paragraphs 1-17, wherein the dispensing section further comprises at least one ridge extending from the upper surface of the dispensing section, between the inner and outer sidewalls of the dispensing section.

19. The disposable cup lid according to any one of paragraphs 1-18, further comprising a removable label disposed over the drinking aperture and adhered to at least the one ridge of the dispensing section.

20. The disposable cup lid according to any one of paragraphs 1-19, further comprising an inner ridge and an outer ridge upwardly extending from the upper surface of the dispensing section and forming a recessed area between the inner ridge and the outer ridge.

21. The disposable cup lid according to any one of paragraphs 1-20, further comprising a removable label disposed over the drinking aperture and adhered to at least the inner ridge and the outer ridge of the dispensing section.

22. The disposable cup lid according to any one of paragraphs 1-21, wherein the dispensing section further comprises a gap defined between the recessed area, the removable label, the inner ridge, and the outer ridge, and wherein the gap is in fluid communication with the drinking aperture.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. And if applicable, all patents, test procedures, and other documents cited in this application are fully incorporated by reference to the extent such disclosure is not inconsistent with this application and for all jurisdictions in which such incorporation is permitted.

While the foregoing is directed to certain illustrative embodiments, other and further embodiments of the invention can be devised without departing from the basic scope thereof, and the scope thereof is determined by the claims that follow.

What is claimed is:

1. A disposable cup lid for use with a beverage container, comprising:

a base;

an annular rim disposed about the base and configured to engage the beverage container;

a crown extending upward from at least a portion of the base, wherein the crown comprises an upper surface, an inner sidewall, and an outer sidewall;

a dispensing section located within a portion of the crown, wherein the dispensing section comprises an upper surface, an inner sidewall, and an outer sidewall, wherein a generally straight portion of the inner sidewall of the dispensing section opposes a generally straight portion of the outer sidewall of the dispensing section; and a drinking aperture formed through the upper surface of the dispensing section to allow fluid to pass therethrough.

2. The disposable cup lid of claim 1, wherein the outer sidewall of the dispensing section is nearer the annular rim and the inner sidewall of the dispensing section is nearer the base.

3. The disposable cup lid of claim 2, wherein the generally straight portion of the inner sidewall of the dispensing section is perpendicular to the annular rim.

4. The disposable cup lid of claim 2, wherein the generally straight portion of the outer sidewall of the dispensing section is angled from a lower end of the dispensing section toward the upper surface of the dispensing section.

5. The disposable cup lid of claim 1, wherein a first transition between the generally straight portion of the inner sidewall and the upper surface of the dispensing section is generally parallel in at least one dimension with a second transition between the generally straight portion of the outer sidewall and the upper surface of the dispensing section.

6. The disposable cup lid of claim 5, wherein the upper surface of the dispensing section has a length of about 20 mm to about 60 mm and a width of about 2 mm to about 10 mm, wherein the length of the upper surface is defined by the length of the outer sidewall of the dispensing section, and wherein the width of the upper surface is defined between the inner sidewall and the outer sidewall of the dispensing section.

7. The disposable cup lid of claim 1, wherein the dispensing section further comprises an transition between the annular rim and the outer sidewall of the dispensing section, and wherein the dispensing section further comprises an transition between the inner sidewall and the upper surface of the dispensing section.

8. The disposable cup lid of claim 1, wherein the dispensing section further comprises an transition between the inner sidewall and the upper surface of the dispensing section.

9. The disposable cup lid of claim 1, further comprising a recessed region defined by the base and the inner sidewall of the crown, and wherein the inner sidewall of the crown and the outer sidewall of the crown are generally circular on either side of the dispensing section.

10. The disposable cup lid of claim 1, wherein the outer sidewall of the crown is generally circular having an arc with an angle of greater than 250 degrees and less than 350 degrees centered with the annular rim.

11. The disposable cup lid of claim 1, wherein a first section of the outer sidewall of the crown is generally circular having an arc with an angle of about 270 degrees to about 330 degrees centered with the annular rim and a second section of the outer sidewall of the crown comprises the generally straight portion of the outer sidewall of the dispensing section.

12. The disposable cup lid of claim 1, wherein the inner sidewall of the crown comprises two generally circular sections having a common center separated by two generally straight sections, wherein each of the generally circular sections of the inner sidewall of the crown has an arc with an angle of about 90 degrees to about 130 degrees centered with the annular rim.

13. The disposable cup lid of claim 1, wherein the inner sidewall of the crown is angled from the base toward the upper surface of the crown, and wherein the outer sidewall of the crown is angled from the annular rim toward the upper surface of the crown.

14. The disposable cup lid of claim 1, wherein the crown further comprises a beveled inner surface between the upper surface of the crown and the inner sidewall of the crown.

15. The disposable cup lid of claim 1, further comprising a removable label disposed over the drinking aperture and at least a portion of the dispensing section.

16. The disposable cup lid of claim 1, wherein the dispensing section further comprises at least one ridge extending from the upper surface of the dispensing section, between the inner and outer sidewalls of the dispensing section.

17. The disposable cup lid of claim 16, further comprising a removable label disposed over the drinking aperture and adhered to at least the one ridge of the dispensing section.

18. The disposable cup lid of claim 1, further comprising an inner ridge and an outer ridge upwardly extending from the upper surface of the dispensing section and forming a recessed area between the inner ridge and the outer ridge.

19. The disposable cup lid of claim 18, further comprising a removable label disposed over the drinking aperture and adhered to at least the inner ridge and the outer ridge of the dispensing section.

20. The disposable cup lid of claim 19, wherein the dispensing section further comprises a gap defined between the recessed area, the removable label, the inner ridge, and the outer ridge, and wherein the gap is in fluid communication with the drinking aperture.

21. A disposable cup lid for use with a beverage container, comprising:

an annular rim configured to engage the beverage container;

a crown extending upward from at least a portion of the annular rim, wherein the crown comprises an upper surface, an inner sidewall, and an outer sidewall;

a dispensing section located within a portion of the crown, wherein the dispensing section comprises an upper surface, an inner sidewall, and an outer sidewall, wherein a generally straight portion of the inner sidewall of the dispensing section opposes a generally straight portion of the outer sidewall of the dispensing section; and a drinking aperture formed through the upper surface of the dispensing section to allow fluid to pass therethrough, wherein a first section of the outer sidewall of the crown is generally circular having an arc with an angle of about 270 degrees to about 330 degrees centered with the annular rim and a second section of the outer sidewall of the crown comprises the generally straight portion of the outer sidewall of the dispensing section, and wherein the inner sidewall of the crown comprises two generally circular sections having a common center separated by two generally straight sections, and wherein each of the generally circular sections of the inner sidewall of the crown has an arc with an angle of about 90 degrees to about 130 degrees centered with the annular rim.

22. A disposable cup lid for use with a beverage container, comprising:

an annular rim configured to engage the beverage container;

a crown extending upward from at least a portion of the annular rim, wherein the crown comprises an upper surface, an inner sidewall, and an outer sidewall;

a dispensing section located within a portion of the crown, wherein the dispensing section comprises an upper surface, an inner sidewall, and an outer sidewall, wherein a generally straight portion of the inner sidewall of the dispensing section opposes a generally straight portion of the outer sidewall of the dispensing section; and a drinking aperture formed through the upper surface of the dispensing section to allow fluid to pass therethrough, wherein:

a first section of the outer sidewall of the crown is generally circular and centered with the annular rim and a second section of the outer sidewall of the crown comprises the generally straight portion of the outer sidewall of the dispensing section, the inner sidewall of the crown comprises two generally circular sections centered with the annular rim separated by two generally straight sections, each of the two generally circular sections of the inner sidewall of the crown has an arc with an angle of greater than 90 degrees, the two generally straight sections of the inner sidewall of the crown are generally parallel in at least one dimension, and one of the two generally straight sections of the inner sidewall of the crown comprises the generally straight portion of the inner sidewall of the dispensing section.

* * * * *